US010281848B2

(12) United States Patent
Wada et al.

(10) Patent No.: US 10,281,848 B2
(45) Date of Patent: May 7, 2019

(54) IMAGE FORMING APPARATUS AND IMAGE FORMING METHOD

(71) Applicants: Yuuji Wada, Kanagawa (JP); Naoto Kochi, Tokyo (JP); Hiroki Nakamatsu, Kanagawa (JP); Kazuki Yogosawa, Kanagawa (JP); Takahiro Suzuki, Tokyo (JP); Shinya Tanaka, Kanagawa (JP); Kenji Sugiura, Kanagawa (JP); Naohiro Kumagai, Kanagawa (JP); Seiichi Kogure, Kanagawa (JP); Junpei Fujita, Kanagawa (JP); Hirokazu Ishii, Tokyo (JP); Takehide Mizutani, Tokyo (JP); Atsushi Nagata, Kanagawa (JP); Keigo Nakamura, Kanagawa (JP)

(72) Inventors: Yuuji Wada, Kanagawa (JP); Naoto Kochi, Tokyo (JP); Hiroki Nakamatsu, Kanagawa (JP); Kazuki Yogosawa, Kanagawa (JP); Takahiro Suzuki, Tokyo (JP); Shinya Tanaka, Kanagawa (JP); Kenji Sugiura, Kanagawa (JP); Naohiro Kumagai, Kanagawa (JP); Seiichi Kogure, Kanagawa (JP); Junpei Fujita, Kanagawa (JP); Hirokazu Ishii, Tokyo (JP); Takehide Mizutani, Tokyo (JP); Atsushi Nagata, Kanagawa (JP); Keigo Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 121 days.

(21) Appl. No.: 15/427,735

(22) Filed: Feb. 8, 2017

(65) Prior Publication Data

US 2017/0235258 A1 Aug. 17, 2017

(30) Foreign Application Priority Data

Feb. 15, 2016 (JP) ..... 2016-026305
Apr. 14, 2016 (JP) ..... 2016-081446

(51) Int. Cl.
*G03G 15/16* (2006.01)
*G03G 15/00* (2006.01)

(52) U.S. Cl.
CPC ..... *G03G 15/1675* (2013.01); *G03G 15/5029* (2013.01); *G03G 15/1605* (2013.01); *G03G 2215/00738* (2013.01)

(58) Field of Classification Search
CPC ..... G03G 15/1605; G03G 15/1675; G03G 15/5029; G03G 2215/00738
See application file for complete search history.

(56) References Cited

U.S. PATENT DOCUMENTS 9,310,722 B2 * 4/2016 Tanaka ..... G03G 15/0131
9,983,538 B2 * 5/2018 Takeuchi ..... G03G 15/1605
(Continued)

FOREIGN PATENT DOCUMENTS

JP 9-106192 4/1997
JP 2006-267486 10/2006
(Continued)

*Primary Examiner* — Francis C Gray
(74) *Attorney, Agent, or Firm* — Oblon, McClelland, Maier & Neustadt, L.L.P.

(57) ABSTRACT

An improved image forming apparatus includes an image bearer, a nip forming member, a transfer power source, and a controller. The controller switches a transfer mode between a first mode to transfer the toner image onto a first type sheet having a surface smoothness higher than a surface smoothness of a second type sheet and a second mode to transfer the toner image onto the second type sheet. The controller controls the transfer power source to output the transfer bias having an opposite-peak duty of greater than or equal to 50% that is a duty on the side of the opposite-peak value in the first mode. The controller controls the transfer power source to output the transfer bias having an opposite-peak duty of less than 50%, which is different from the opposite-peak duty of the first mode, in the second mode.

20 Claims, 16 Drawing Sheets

(56) References Cited

U.S. PATENT DOCUMENTS

| | | | | |
|---|---|---|---|---|
| 2010/0329707 | A1* | 12/2010 | Yamada | G03G 15/161 399/44 |
| 2012/0045237 | A1* | 2/2012 | Aoki | G03G 15/1675 399/66 |
| 2012/0243892 | A1 | 9/2012 | Nakamura et al. | |
| 2013/0287415 | A1* | 10/2013 | Nakagawa | G03G 15/065 399/44 |
| 2014/0010562 | A1 | 1/2014 | Tanaka et al. | |
| 2014/0023387 | A1* | 1/2014 | Goto | G03G 15/1615 399/66 |
| 2014/0079418 | A1 | 3/2014 | Tanaka et al. | |
| 2014/0328604 | A1 | 11/2014 | Tanaka et al. | |
| 2015/0212453 | A1 | 7/2015 | Tanaka | |
| 2016/0109832 | A1 | 4/2016 | Ohsugi et al. | |
| 2016/0161888 | A1* | 6/2016 | Wada | G03G 15/1665 399/66 |
| 2016/0170363 | A1* | 6/2016 | Kogure | G03G 15/6558 399/316 |
| 2016/0170364 | A1* | 6/2016 | Kogure | G03G 15/161 399/316 |
| 2016/0274504 | A1 | 9/2016 | Wada et al. | |

FOREIGN PATENT DOCUMENTS

| | | |
|---|---|---|
| JP | 2011-013241 | 1/2011 |
| JP | 2014-010383 | 1/2014 |
| JP | 2014-077981 | 5/2014 |
| JP | 2014-232127 | 12/2014 |
| JP | 2015-165291 | 9/2015 |
| JP | 2016-080826 | 5/2016 |
| JP | 2016-118605 | 6/2016 |

* cited by examiner

IMAGE FORMING APPARATUS AND IMAGE FORMING METHOD

CROSS-REFERENCE TO RELATED APPLICATIONS

This patent application is based on and claims priority pursuant to 35 U.S.C. § 119(a) to Japanese Patent Application No. 2016-026305, filed on Feb. 15, 2016 and Japanese Patent Application No. 2016-081446, filed on Apr. 14, 2016 in the Japan Patent Office, the entire disclosures of which are hereby incorporated by reference herein.

BACKGROUND

Technical Field

Exemplary aspects of the present disclosure generally relate to an image forming apparatus and an image forming method.

Related Art

There has been known an image forming apparatus that outputs a transfer bias (transfer current) in which an alternating current (AC) voltage is superimposed on a direct current (DC) voltage to a transfer nip formed by an image bearer contacting a nip forming member, thereby transferring a toner image from a surface of the image bearer onto a recording sheet in the transfer nip.

In such an image forming apparatus, for example, a secondary-transfer power source outputs a secondary-transfer bias as transfer current to a secondary-transfer nip formed by a nip forming roller as a nip forming member contacting an intermediate transfer belt as the image bearer. The secondary-transfer power source outputs a secondary-transfer bias including only the DC voltage to transfer a toner image from the intermediate transfer belt onto a recording sheet without unevenness on the surface thereof. However, the secondary-transfer power source outputs a superimposed voltage, in which the AC voltage is superimposed on the DC voltage, as the secondary-transfer bias to form an alternating electrical field within the secondary-transfer nip to transfer the toner image from the intermediate transfer belt onto a recording sheet with an uneven surface, such as Japan paper. Such a generated alternating electrical field reciprocates toner between the surface of the intermediate transfer belt and the recesses on the surface of the recording sheet in the secondary-transfer nip, thereby secondarily transferring toner onto the recesses on the surface of the recording sheet in a successful manner.

SUMMARY

In an aspect of this disclosure, there is provided an improved image forming apparatus including an image bearer bearing a toner image, a nip forming member contacting the image bearer to form a transfer nip, a transfer power source, and a controller. The transfer power source outputs a transfer bias including a superimposed voltage, in which an alternating current (AC) voltage is superimposed on a direct current (DC) voltage, to transfer the toner image borne on the image bearer onto a recording sheet disposed between the image bearer and the nip forming member. Two peak values of the transfer bias are a transfer peak value to move toner from the image bearer to the nip forming member and an opposite-peak value in an opposite side of the transfer peak value. The controller switches a transfer mode between a first mode to transfer the toner image onto a first type sheet having a surface smoothness higher than a surface smoothness of a second type sheet and a second mode to transfer the toner image onto the second type sheet. The controller controls the transfer power source to output the transfer bias having an opposite-peak duty of greater than or equal to 50% that is a duty on the side of the opposite-peak value in the first mode. The controller controls the transfer power source to output the transfer bias having an opposite-peak duty of less than 50% in the second mode.

In another aspect of this disclosure, there is provided an improved image forming method including outputting a transfer bias including a superimposed bias, in which an alternating current (AC) voltage is superimposed on a direct current (DC) voltage, from a transfer power source to a transfer nip formed by an image bearer contacting a nip forming member; transferring a toner image from the image bearer onto a recording sheet disposed between the image hearer and the nip forming member; switching a transfer mode between a first mode to transfer the toner image onto a first type sheet having a surface smoothness higher than a surface smoothness of a second type sheet and a second mode to transfer the toner image onto the second type sheet; and controlling the transfer power source to output the transfer bias having an opposite-peak duty of greater than or equal to 50% in the first mode and output the transfer bias having an opposite-peak duty of less than 50%, which is different from the opposite-peak duty of the first mode, in the second mode. Two peak values of the transfer bias are a transfer peak value to move toner from the image bearer to the nip forming member and an opposite-peak value in an opposite side of the transfer peak value.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
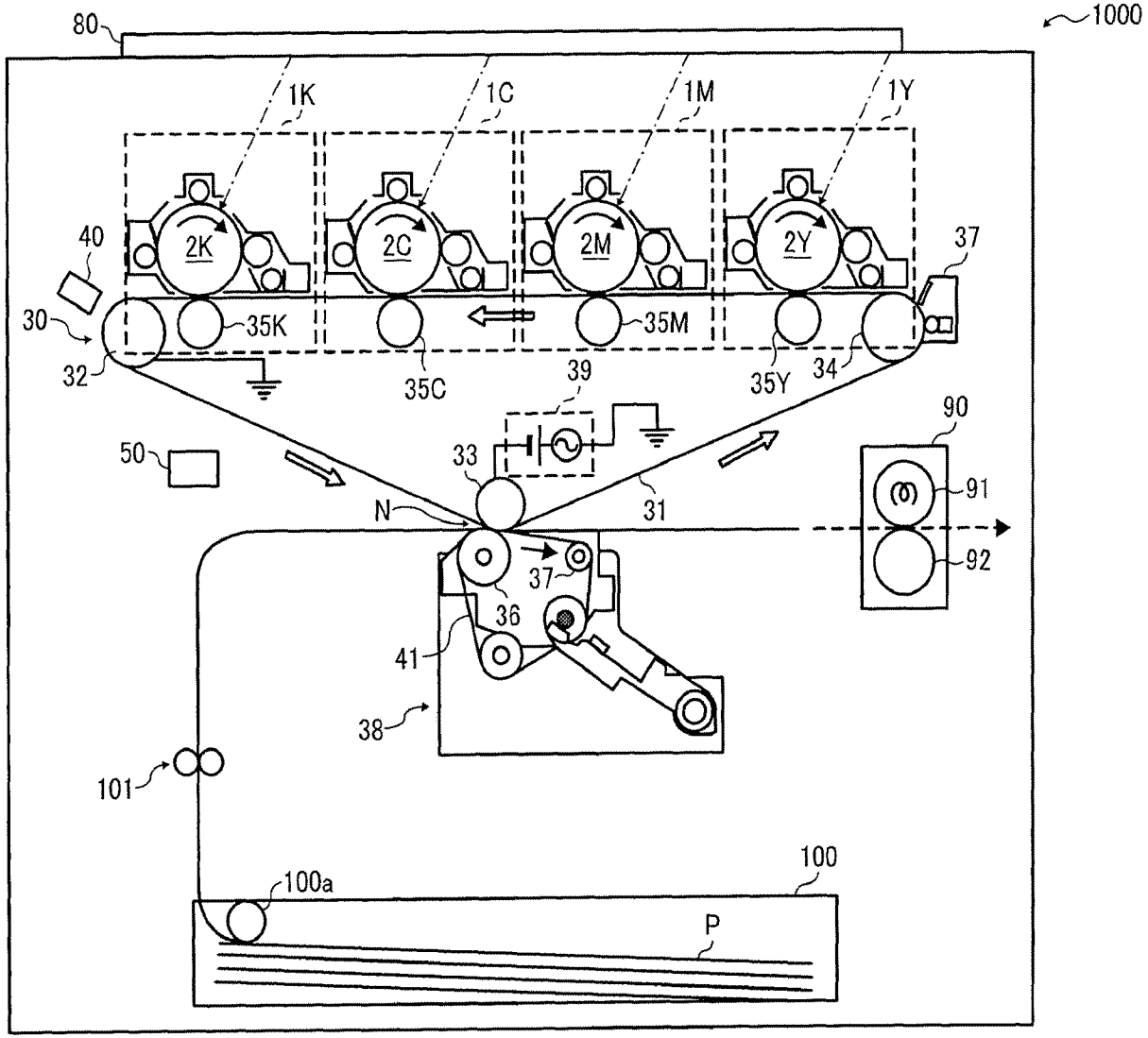
FIG. 1 is a schematic view of an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure arc not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

The following describes an electrophotographic color printer as an example of an image forming apparatus according to a first embodiment of the present disclosure. The various aspects of the present disclosure adapt to, not limited to a printer (an image forming apparatus), other types of image forming apparatuses, such as multicolor copiers, fax machines, and multifunction peripherals having the capabilities of the multicolor copiers and the fax machines.

A configuration of an image forming apparatus 1000 according to the first embodiment of the present disclosure is first described. FIG. 1 is a schematic view of the image forming apparatus 1000 according to the present embodiment. As illustrated in FIG. 1, the image forming apparatus 1000 includes four toner image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is described. The image forming apparatus 1000 also includes a transfer unit 30, an optical writing unit 80, a fixing device 90, a sheet tray 100, and a pair of registration rollers 101.

Figure 2:
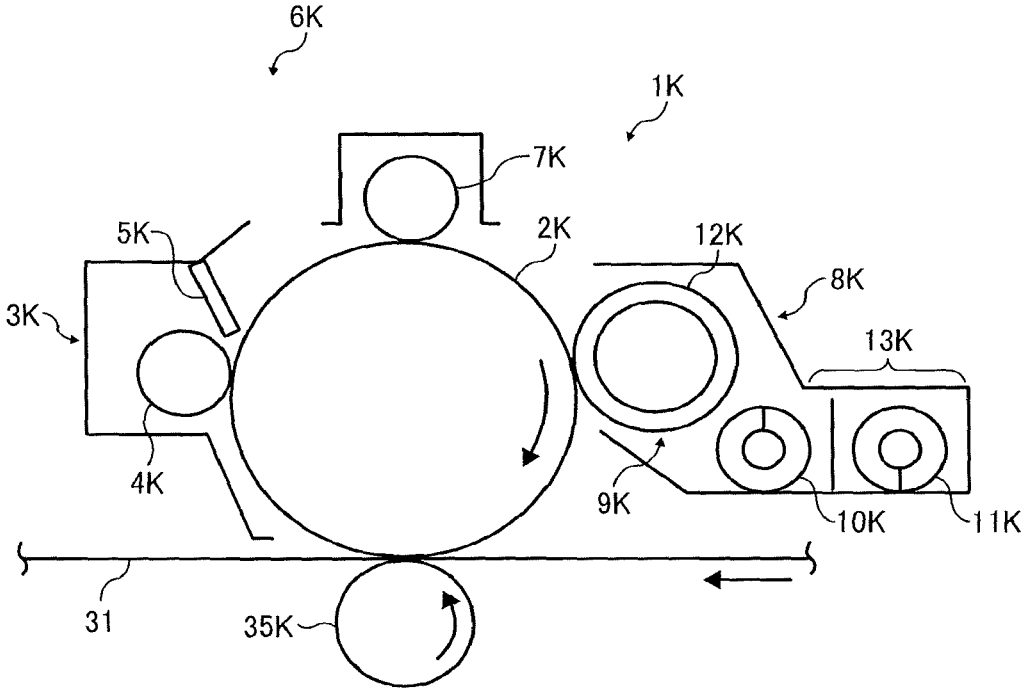
FIG. 2 is a schematic view of an image forming unit for the color black as a representative example of image forming units employed in the image forming apparatus of FIG. 1.

The image forming units 1Y, 1M, 1C, and 1K all have the same configuration, differing in the color of toner employed. The image forming units 1Y, 1M, 1C, and 1K are replaced upon reaching their product life cycles. FIG. 2 is a schematic diagram illustrating the toner image forming unit 1K. The toner image forming unit 1K includes a photoconductor 2K serving as a latent image bearer that bears an image. The photoconductor 2K is surrounded by various pieces of imaging equipment, such as a charging device 6K, a developing device 8K, a photoconductor cleaner 3K, and a charge remover. These devices are held by a common holder so that they are detachably attachable and replaced at the same time.

The photoconductor 2K includes a drum-shaped base on which an organic photosensitive layer is disposed. The photoconductor 2K is rotated in a clockwise direction by a driving device. The charging device 6K includes a charging roller 7K to which a charging bias is applied. The charging roller 7K contacts or is disposed in proximity to the photoconductor 2K to generate electrical discharge between the charging roller 7K and the photoconductor 2K, thereby charging uniformly the surface of the photoconductor 2K. According to the present embodiment, the photoconductor 2K is uniformly charged negatively, which is the same polarity as that of normally-charged toner. As a charging bias, an alternating current (AC) voltage superimposed on a direct current (DC) voltage is employed. The charging roller 7K includes a metal cored bar coated with a conductive elastic layer made of a conductive elastic material. According to the present embodiment, the photoconductor 2K is charged by the charging roller 7K contacting the photoconductor 2K or disposed near the photoconductor 2K. Alternatively, a corona charger may be employed.

The uniformly charged surface of the photoconductor 2K is scanned by laser light projected from the optical writing unit 80, thereby forming an electrostatic latent image for black on the surface of the photoconductor 2K. The electrostatic latent image for black on the photoconductor 2K is developed with black toner by the developing device 8K. Accordingly, a visible image, also known as a toner image of black, is formed on the photoconductor 2K. As will be described later in detail, the toner image is transferred primarily onto an intermediate transfer belt 31 in a process known as a primary transfer process.

The photoconductor cleaner 3K removes residual toner remaining on the surface of the photoconductor 2K after the primary transfer process, that is, after the photoconductor 2K passes through a primary transfer nip. The photoconductor cleaner 3K includes a brush roller 4K and a cleaning blade 5K. The cleaning blade 5K is cantilevered, that is, one end of the cleaning blade 5K is fixed to the housing of the photoconductor cleaner 3K, and its free end contacts the surface of the photoconductor 2K. The brush roller 4K rotates and brushes off the residual toner from the surface of the photoconductor 2K while the cleaning blade 5K removes the residual toner by scraping.

The charge remover removes residual charge remaining on the photoconductor 2K after the surface thereof is cleaned by the photoconductor cleaner 3K. The surface of the photoconductor 2K is initialized in preparation for the subsequent imaging cycle.

The developing device 8K as a developer bearer includes a developing portion 12K and a developer conveyor 13K. The developing portion 12K includes a developing roller 9K inside thereof. The developer conveyor 13K stirs a black developing agent and transports the black developing agent. The developer conveyor 13K includes a first chamber equipped with a first screw 10K and a second chamber equipped with a second screw 11K. The first screw 10K and the second screw 11K are each constituted of a rotatable shaft and helical fighting wrapped around the circumferential surface of the shaft. Each end of the shaft of the first screw 10 and the second screw 11K in the axial direction of the shaft is rotatably held by shaft bearings.

The first chamber with the first screw 10K and the second chamber with the second screw 11K are separated by a wall, but each end of the wall in the axial direction of the screw shaft has a connecting hole through which the first chamber and the second chamber communicate. The first screw 10K mixes the developing agent by rotating the helical fighting and carries the developing agent from the distal end to the proximal end of the screw in the direction perpendicular to the drawing plane while rotating. The first screw 10K is disposed parallel to and facing the developing roller 9K. The black developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical fighting of the second screw 11K. As the second screw 11K rotates, the developing agent is delivered from the proximal end to the distal end in FIG. 2 while being mixed in the direction of rotation.

In the second chamber, a toner density sensor for detecting the density of the toner in the developing agent is disposed at the bottom of a casing of the chamber. As the toner density sensor, a magnetic permeability detector is employed. There is a correlation between the toner density and the magnetic permeability of the developing agent consisting of toner particles and magnetic carrier particles. Therefore, the magnetic permeability detector can detect the density of the toner.

The image forming apparatus 1000 includes toner supply devices to supply independently toners of yellow, magenta, cyan, and black to the second chamber of the respective developing devices 8Y, 8M, 8C, and 8K. The controller of the image forming apparatus includes a Random Access Memory (RAM) to store a target output voltage Vtref for output voltages provided by the toner density sensors for yellow, magenta, cyan, and black. If the difference between the output voltages provided by the toner density sensors for yellow, magenta, cyan, and black, and Vtref for each color exceeds a predetermined value, the toner supply devices are driven for a predetermined time period corresponding to the difference to supply toner. Accordingly, the respective color of toner is supplied to the second chamber of the developing device 8, so that the toner density of the developer for each color maintains within a predetermined range.

The developing roller 9K in the developing portion 12K faces the first screw 10K as well as the photoconductor 2K through an opening formed in the casing of the developing device 8K. The developing roller 9K includes a cylindrical developing sleeve made of a non-magnetic pipe which is rotated, and a magnetic roller disposed inside the developing sleeve. The magnetic roller is fixed so as not to rotate together with the developing sleeve. The black developing agent supplied from the first screw 10K is carried on the surface of the developing sleeve due to the magnetic force of the magnetic roller. As the developing sleeve rotates, the developing agent is transported to a developing area facing the photoconductor 2K.

The developing sleeve is supplied with a developing bias having the same polarity as the polarity of toner. An absolute value of the developing bias is greater than the potential of the electrostatic latent image on the photoconductor 2K, but less than the charge potential of the uniformly charged photoconductor 2K. With this configuration, a developing potential that causes the toner on the developing sleeve to move electrostatically to the electrostatic latent image on the photoconductor 2K acts between the developing sleeve and the electrostatic latent image on the photoconductor 2K. A background potential acts between the developing sleeve and a background portion (non-image formation area) of the photoconductor 2K, causing the toner on the developing sleeve to move to the sleeve surface. Due to the background potential and the non-developing potential, the toner on the developing sleeve moves selectively to the electrostatic latent image formed on the photoconductor 2K, thereby forming a visible image, known as a toner image.

Similar to the toner image forming unit 1K, toner images of yellow, magenta, and cyan are formed on the photoconductors 2Y, 2M, and 2C of the toner image forming units 1Y, 1M, and 1C, respectively. The optical writing unit 80 for writing a latent image on the photoconductors 2 is disposed above the toner image forming units 1Y, 1M, 1C, and 1K. Based on image information provided by an external device such as a personal computer (PC), the optical writing unit 80 illuminates the photoconductors 2Y, 2M, 2C, and 2K with the laser light projected from a laser diode of the optical writing unit 80. Accordingly, the electrostatic latent images of yellow, magenta, cyan, and black arc formed on the photoconductors 2Y, 2M, 2C, and 2K, respectively. The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photoconductor 2Y. Alternatively, the optical writing unit 80 may employ a light source using an LED array including a plurality of LEDs that projects light.

Referring back to FIG. 2, a description is provided of the transfer unit 30. The transfer unit 30 is disposed below the toner image forming units 1Y, 1M, 1C, and 1K. The transfer unit 30 includes the intermediate transfer belt 31 serving as an image bearing member formed into an endless loop and rotated in the counterclockwise direction. The transfer unit 30 also includes a plurality of rollers: a drive roller 32, a secondary-transfer first roller 33, a cleaning auxiliary roller 34, and four primary transfer rollers 35Y, 35M, 35C, and 35K (which may be referred to collectively as primary transfer rollers 35). The transfer unit 30 further includes a belt cleaning device 37 and a density sensor 40.

The intermediate transfer belt 31 is entrained around and stretched taut between the plurality of rollers, i.e., the drive roller 32, the secondary-transfer first roller 33, the cleaning auxiliary roller 34, and the four primary transfer rollers 35Y, 35M, 35C, and 35K. The drive roller 32 is rotated in the counterclockwise direction by a motor or the like, and rotation of the driving roller 32 enables the intermediate transfer belt 31 to rotate in the same direction.

The intermediate transfer belt 31 is interposed between the photoconductors 2Y, 2M, 2C, and 2K, and the primary transfer rollers 35Y, 35M, 35C, and 35K. Accordingly, primary transfer nips are formed between the outer peripheral surface or the image bearing surface of the intermediate transfer belt 31 and the photoconductors 2Y, 2M, 2C, and 2K that contact the intermediate transfer belt 31. A primary transfer power source applies a primary transfer bias to the primary transfer rollers 35Y, 35M, 35C, and 35K. Accordingly, a transfer electric field is formed between the primary transfer rollers 35Y, 35M, 35C, and 35K, and the toner images of yellow, magenta, cyan, and black formed on the photoconductors 2Y, 2M, 2C, and 2K. The yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electrical field and the nip pressure. The intermediate transfer belt 31, on which the yellow toner image has been transferred, sequentially passes through the primary transfer nips of magenta, cyan, and black. Subsequently, the toner images on the photoconductors 2M, 2C, and 2K are superimposed on the yellow toner image which has been transferred on the intermediate transfer belt 31, one atop the other, thereby forming a composite toner image on the intermediate transfer belt 31 in the primary transfer process. Accordingly, the composite toner image, in which the toner images of yellow, magenta, cyan, and black are superimposed one atop the other, is formed on the surface of the intermediate transfer belt 31. According to the present embodiment described above, a roller-type transfer device (here, the primary transfer rollers 35) is used as a primary transfer device. Alternatively, a transfer charger or a brush-type transfer device may be employed as a primary transfer device.

A sheet conveyor unit 38, disposed substantially below the transfer unit 30, includes a secondary-transfer second roller 36 disposed opposite to the secondary-transfer first roller 33 via the intermediate transfer belt 31 and a sheet conveyor belt 41 (generally referred to as a secondary transfer belt or a secondary transfer member). As illustrated in FIG. 1, the sheet conveyor belt 41 is formed into an endless loop and looped around a plurality of rollers including the secondary-transfer second roller 36. As the secondary-transfer second roller 36 is driven to rotate, the sheet conveyor belt 41 is rotated in the clockwise direction in FIG. 1. The secondary-transfer second roller 36 contacts, via the sheet conveyor belt 41, a portion of the front surface or the image bearing surface of the intermediate transfer belt 31 looped around the secondary-transfer first roller 33, thereby forming a secondary transfer nip N therebetween. That is, the intermediate transfer belt 31 and the sheet conveyor belt 41 are interposed between the secondary-transfer first roller 33 of the transfer unit 30 and the secondary-transfer second roller 36 of the sheet conveyor unit 38. Accordingly, the outer peripheral surface or the image bearing surface of the intermediate transfer belt 31 contacts the outer peripheral surface of the sheet conveyor belt 41 serving as a nip forming member, thereby forming the secondary transfer nip. The secondary-transfer second roller 36 disposed inside the loop of the sheet conveyor belt 41 is grounded; whereas, a secondary transfer bias is applied to the secondary-transfer first roller 33 disposed inside loop of the intermediate transfer belt 31 by a secondary-transfer power source 39. With this configuration, a secondary transfer electrical field is formed between the secondary-transfer first roller 33 and the secondary-transfer second roller 36 so that the toner having a negative polarity is transferred electrostatically from the secondary-transfer first roller side to the secondary-transfer second roller side. Alternatively, instead of the sheet conveyor belt 41, a secondary transfer roller may be employed as the nip forming member to contact directly the intermediate transfer belt 31.

As illustrated in FIG. 1, the sheet tray 100 storing a sheaf of recording sheets P as a recording medium is disposed below the transfer unit 31. The sheet tray 100 is equipped with a feed roller 100*a* that contacts the top sheet of the sheaf of recording sheets P. As the feed roller 100*a* is rotated at a predetermined speed, the feed roller 100*a* picks up and sends the top sheet of the recording sheets P to a sheet delivery path. Substantially near the end of the sheet delivery path, the pair of registration rollers 101 is disposed. The pair of registration rollers 101 stops rotating temporarily as soon as the recording sheet P fed from the sheet tray 100 is interposed between the pair of registration rollers 101. The pair of registration rollers 101 starts to rotate again to feed the recording sheet P to the secondary transfer nip N in appropriate timing such that the recording sheet P is aligned with the composite toner image formed on the intermediate transfer belt 31 at the secondary transfer nip. In the secondary transfer nip N, the recording sheet P tightly contacts the composite toner image on the intermediate transfer belt 31, and the composite toner image is secondarily transferred onto the recording sheet P by the secondary transfer electric field and the nip pressure applied thereto, thereby forming a full-color toner image on the recording sheet P. The recording sheet P, on which the full-color toner image is formed, passes through the secondary transfer nip N and separates from the intermediate transfer belt 31 due to self-stripping.

Furthermore, the curvature of a separation roller 42, around which the sheet conveyor belt 41 is looped, enables the recording sheet P to separate from the sheet conveyor belt 41.

According to the present embodiment, the sheet conveyor belt 41 as the nip forming member contacts the intermediate transfer belt 31 to form the secondary transfer nip N. Alternatively, a nip forming roller as the nip forming member may contact the intermediate transfer belt 31 to form the secondary transfer nip.

After the intermediate transfer belt 31 passes through the secondary transfer nip N, residual toner not having been transferred onto the recording sheet P remains on the intermediate transfer belt 31. The residual toner is removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports the cleaning operation performed by the belt cleaning device 37.

As illustrated in FIG. 1, the density sensor 40 is disposed outside the loop formed by the intermediate transfer belt 31. More specifically, the density sensor 40 faces a portion of the intermediate transfer belt 31 looped around the drive roller 32 with a predetermined gap between the density sensor 40 and the intermediate transfer belt 31. An amount of toner adhered to the toner image per unit area (image density) primarily transferred onto the intermediate transfer belt 31 is measured when the toner image comes to the position opposite to the density sensor 40.

The fixing device 90 is disposed downstream from the secondary transfer nip N in the direction of conveyance of the recording sheet P. The fixing device 90 includes a fixing roller 91 and a pressing roller 92. The fixing roller 91 includes a heat source such as a halogen lamp inside the fixing roller 91. While rotating, the pressing roller 92 pressingly contacts the fixing roller 91, thereby forming a heated area called a fixing nip therebetween. The recording sheet P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording sheet P in the fixing nip. Subsequently, the recording sheet P is output outside the image forming apparatus from the fixing device 90 via a post-fixing delivery path after the fixing process.

According to the present embodiment, for forming a monochrome image, an orientation of a support plate supporting the primary transfer rollers 35Y, 35M, and 35C of the transfer unit 30 is changed by driving a solenoid or the like. With this configuration, the primary transfer rollers 35Y, 35M, and 35C are separated from the photoconductors 2Y, 2M, and 2C, thereby separating the outer peripheral surface or the image bearing surface of the intermediate transfer belt 31 from the photoconductors 2Y, 2M, and 2C. In a state in which the intermediate transfer belt 31 contacts only the photoconductor 2K, only the toner image forming unit 1K for black among four toner image forming units is driven to form a black toner image on the photoconductor 2K. It is to be noted that the present disclosure can be applied to both an image forming apparatus for forming a color image and a monochrome image forming apparatus for forming a single-color image.

Figure 3:
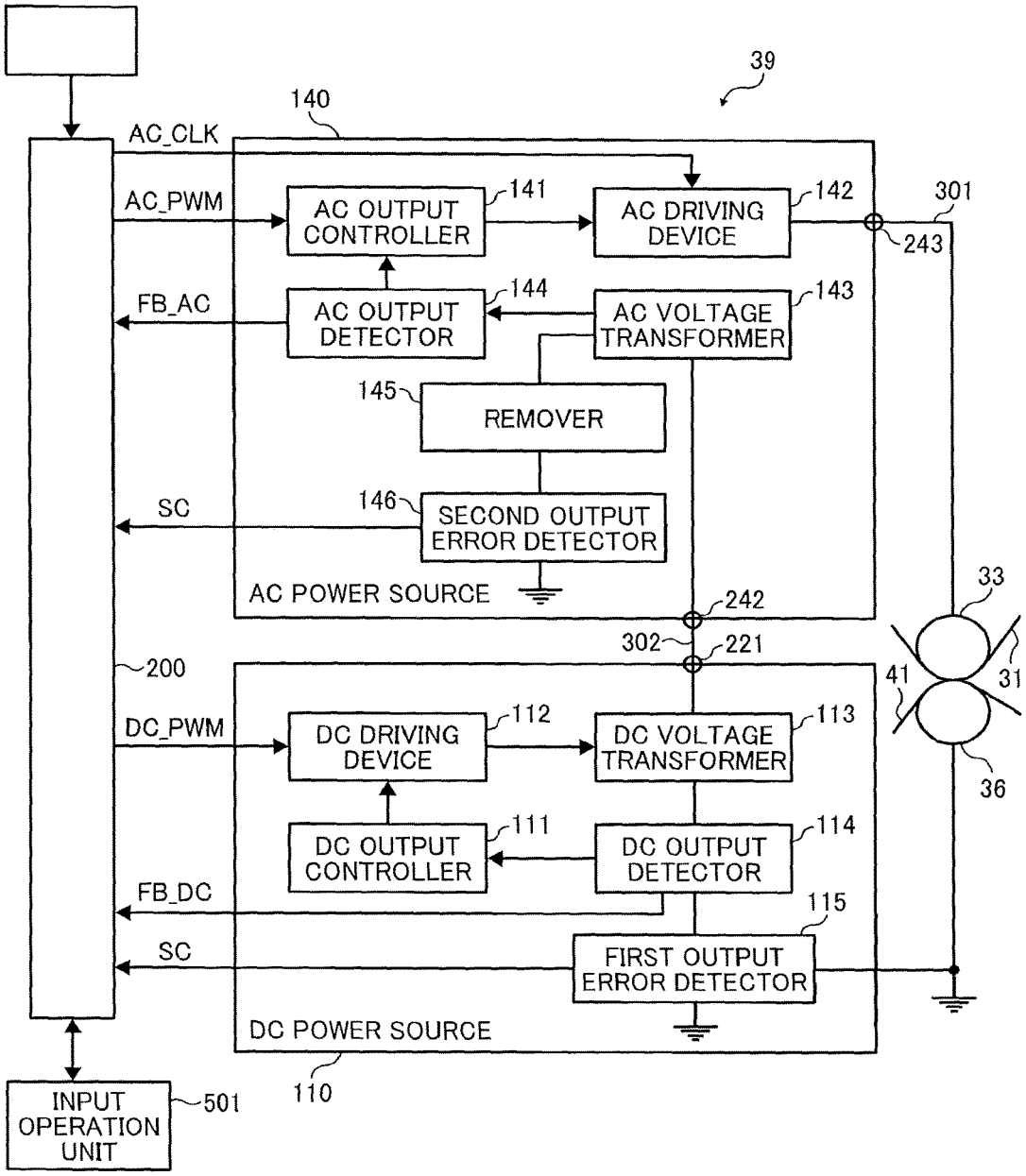
FIG. 3 is a block diagram of a portion of an electrical circuit of a secondary-transfer power source employed in the image forming apparatus of FIG. 1.
Figure 5:
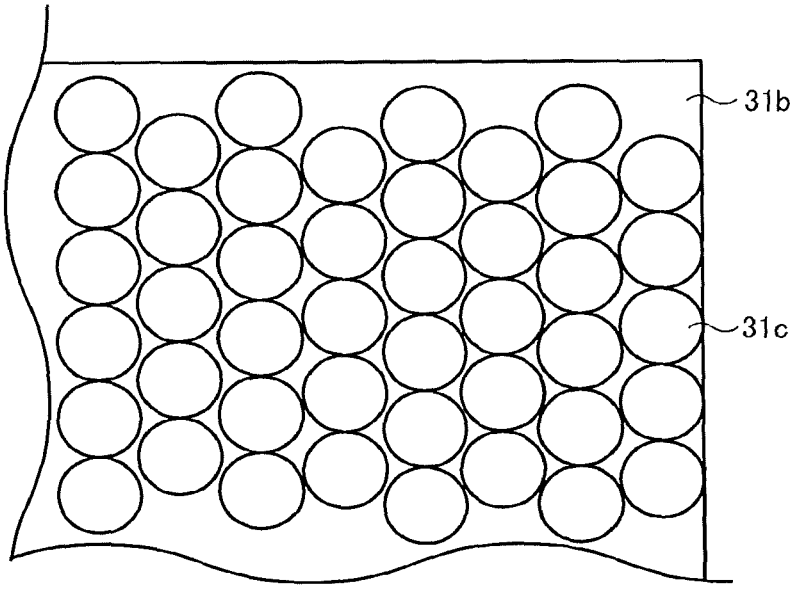
FIG. 5 is a partially enlarged plan view of the intermediate transfer belt.

FIG. 3 is a block diagram of a portion of an electrical circuit of a secondary-transfer power source, and the secondary-transfer first roller 33 and the secondary-transfer second roller 36 according to an embodiment of the present disclosure. As illustrated in FIG. 5, the secondary transfer power source 39 includes a direct current (DC) power source 110 and an alternating current (AC) power source 140, a power-source controller 200, and so forth. The AC power source 140 is detachably mountable relative to a maim body of the secondary-transfer power source 39. The DC power source 110 outputs a DC voltage to apply an electrostatic force to toner on the intermediate transfer belt 31 so that the toner moves from the intermediate transfer belt 31 to the recording sheet P in the secondary-transfer nip N. The DC power source 110 includes a DC output controller 111, a DC drive device 112, a DC voltage transformer 113, a DC output detector 114, a first output error detector 115, and an electrical connector 221.

The AC power source 140 outputs an alternating current voltage to form an alternating electric field in the secondary transfer nip N. The AC power source 140 includes an AC output controller 141, an AC drive device 142, an AC voltage transformer 143, an AC output detector 144, a remover 145, a second output error detector 146, electrical connectors 242 and 243.

The power-source controller 200 controls the DC power source 110 and the AC power source 140, and is equipped with a central processing unit (CPU), a Read Only Memory (ROM), and a Random Access Memory (RAM). The power-source controller 200 inputs a DC_PWM signal to the DC output controller 111. The DC_PWM signal controls an output level of the DC voltage. Furthermore, an output value of the DC voltage transformer 113 detected by the DC output detector 114 is provided to the DC output controller 111. Based on the duty ratio of the input DC_PWM signal and the output value of the DC voltage transformer 113, the DC output controller 111 controls as follows. The DC_PWM signal controls an output level of the DC voltage. Based on the duty ratio of the input DC_PWM signal and the output value of the DC voltage transformer 113, the DC output controller 111 controls the DC voltage transformer 113 via the DC drive device 112 to adjust the output value of the DC voltage transformer 113 to an output value instructed by the DC_PWM signal. The DC drive device 112 drives the DC voltage transformer 113 in accordance with the instruction from the DC output controller 111. The DC drive device 112 drives the DC voltage transformer 113 to output a DC high voltage having a negative polarity. In a case in which the AC power source 140 is not connected, the electrical connector 221 and the secondary-transfer first roller 33 are electrically connected by a harness 301 so that the DC voltage transformer 113 outputs (applies) a DC voltage to the secondary-transfer first roller 33 via the harness 301. In a case in which the AC power source 140 is connected, the electrical connector 221 and the electrical connector 242 are electrically connected by a harness 302 so that the DC voltage transformer 113 outputs a DC voltage to the AC power source 140 via the harness 302.

The DC output detector 114 detects and outputs an output value of the DC high voltage from the DC voltage transformer 113 to the DC output controller 111. The DC output detector 114 outputs the detected output value as a FB_DC signal (feedback signal) to the power-source controller 200 to control the duty of the DC_PWM signal in the power-source controller 200 so as not to impair transferability due to environment and load. According to the present embodiment, the AC power source 140 is detachably mountable relative to the body of the power-source controller 200. Thus, an impedance in the output path of the high voltage output is different between when the AC power source 140 is connected and when the AC power source 140 is not connected. Consequently, when the DC power source 110 outputs the DC voltage under constant voltage control, the impedance in the output path changes depending on the presence of the AC power source 140, thereby changing a division ratio. Furthermore, the high voltage to be applied to the secondary-transfer first roller 33 varies, causing the transferability to vary depending on the presence of the AC power source 140.

In view of the above, according to the present embodiment, the DC power source 110 outputs the DC voltage under constant current control, and the output voltage is changed depending on the presence of the AC power source 140. With this configuration, even when the impedance in the output path changes, the high voltage to be applied to the secondary-transfer first roller 33 is kept constant, thereby maintaining reliably the transferability irrespective of the presence of the AC power source 140. Furthermore, the AC power source 140 can be detached and attached without changing the DC_PWM signal value. According to the present embodiment, the DC power source 110 is under constant-current control. Alternatively, in some embodiments, the DC power source 110 can be under constant voltage control as long as the high voltage to be applied to the secondary-transfer bias roller 68 is kept constant by changing the DC_PWM signal value upon detachment and attachment of the AC power source 140 or the like.

The first output error detector 115 is disposed on an output line of the DC power source 110. When an output error occurs due to a ground fault or other problems in an electrical system, the first output error detector 115 outputs an SC signal indicating the output error such as leakage to the power-source controller 200. With this configuration, the power-source controller 200 can stop the DC power source 110 to output the high voltage.

The power-source controller 200 inputs an AC_PWM signal and an output value of the AC voltage transformer 143 detected by the AC output detector 144. The AC_PWM signal controls an output level of the AC voltage based on the duty ratio of the input AC_PWM signal and the output value of the AC voltage transformer 143 as follows. The AC_PWM signal controls an output level of the AC voltage. Based on the duty ratio of the input AC_PWM signal and the output value of the AC voltage transformer 143, the AC output controller 141 controls the AC voltage transformer 143 via the AC drive device 142 to adjust the output value of the AC voltage transformer 143 to an output value instructed by the AC PWM signal.

An AC_CLK signal to control the output frequency of the AC voltage is input to the AC drive device 142. The AC drive device 142 drives the AC voltage transformer 143 in accordance with the instruction from the AC output controller 141 and the AC_CLK signal. As the AC drive device 142 drives the AC voltage transformer 143 in accordance with the AC_CLK signal, the output waveform generated by the AC voltage transformer 143 is adjusted to a desired frequency instructed by the AC_CLK signal.

The AC drive device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. In a case in which the AC power source 140 is connected, that is, the electrical connector 243 and the secondary-transfer first roller 33 are electrically connected by the harness 301, the AC voltage transformer 143 outputs (applies) the thus-obtained superimposed voltage to the secondary-transfer first roller 33 via the harness 301. In a case in which the AC voltage transformer 143 does not generate the AC voltage, the AC voltage transformer 143 outputs (applies) the DC high voltage output from the DC voltage transformer 113 to the secondary-transfer first roller 33 via the harness 301. Subsequently, the voltage (the superimposed voltage or the DC voltage) output to the secondary-transfer first roller 33 returns to the DC power source 110 via the secondary-transfer second roller 36.

The AC output detector 144 detects and outputs an output value of the AC voltage from the AC voltage transformer 143 to the AC output controller 141. The AC output detector 144 outputs the detected output value as a FB_AC signal (feedback signal) to the power-source controller 200 to control the duty of the AC_PWM signal in the power-source controller 200 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC power source 140) is either a sine wave or a square wave. According to the present embodiment, the waveform of the AC voltage is a short-pulse square wave. The AC voltage having a short-pulse square wave enhances image quality.

Note that the secondary-transfer power source 39 outputs the DC voltage under the constant current control to adjust the output voltage value so that the output current value coincides with a predetermined target current value. Further, the secondary-transfer power source 39 outputs the AC voltage under the constant voltage control to adjust the amplitude of the AC voltage so that the peak-to-peak value Vpp coincides with a predetermined target value.

A device is known that applies a superimposed voltage as the secondary-transfer bias to the secondary-transfer nip N to form the alternating electrical field, which allows for a successful secondary transfer of toner onto recesses on the surface of the recording sheet having uneven surface. The principle is as follows: In the secondary transfer nip, the secondary-transfer bias including only the DC bias merely transfers a small amount of toner particles of toner forming a toner image from the surface of the intermediate transfer belt onto the recesses of the surface of the recording sheet. Similarly, the secondary-transfer bias including the superimposed voltage merely transfers a small amount of toner particles onto the recesses of the surface of the recording sheet during a time period from a time when a toner image enters the secondary-transfer nip to a time when an initial cycle of the alternating current (AC) component of the secondary-transfer bias ends. However, when another cycle (second cycle) following the initial cycle of the alternating current component ends, the amount of toner particles that transfers from the surface of the secondary transfer belt onto the recesses of the surface of the recording sheet increases. More specifically, in the first half of another cycle following the initial cycle, the toner particles moving from the recesses back to the surface of the secondary transfer belt collide with toner particle remaining on the surface of the secondary transfer belt, thereby reducing the adhesive force between the toner particles remaining on the surface and the other toner particles or the surface of the secondary transfer belt. In the second half of the cycle following the initial cycle, the toner particles having reduced the adhesive force as described above is caused to transfer from the surface of the secondary transfer belt onto the recesses of the surface of the recording sheet together with the toner particles having returned to the surface of the secondary transfer belt. In still another cycle following the second cycle of the alternating current component as well, the similar phenomenon occurs, thereby further increasing the amount of toner particles to be transferred onto the recesses of the surface of the recording sheet. With repetitive reciprocation of the toner particles between the surface of the secondary transfer belt and the recesses of the surface of the recording sheet in the secondary-transfer nip, the amount of toner particles to be transferred onto the recesses of the surface of the recording sheet gradually increases. When the trail end of the toner image exits the secondary-transfer nip, a sufficient amount of toner particles has been transferred into the recesses of the surface of the recording sheet.

Next, a description is provided of a characteristic configuration of the image forming apparatus 1000 according to the present embodiment of the present disclosure.

A typical intermediate transfer belt includes only a belt base made of hard material, such as a polyimide belt. A typical image forming apparatus drives the intermediate transfer belt to travel at a linear velocity of 280 [mm/s] to form an image at a velocity of image formation for general users. To achieve image formation at an ultra-high speed for business users, the present inventors have performed the following tests in the configuration with the intermediate transfer belt including only the belt base made of hard material in combination with the secondary-transfer bias including the superimposed voltage. That is, in the tests, a test image is secondarily transferred on to an uneven surface sheet ("LEATHAC 66" (registered trademark) manufactured by TOKUSHU TOKAI PAPER CO., LTD.) while the intermediate transfer belt endlessly moves at an extremely-high linear velocity of 630 mm/s. As a result, toner fails to be secondarily transferred onto the recesses of the surface of the recording sheet having an uneven surface, thus causing uneven image density due to the surface unevenness of the sheet even though the secondary-transfer bias including the superimposed voltage is adopted. Thus, in an attempt to form an image at an ultra-high speed for business users using the intermediate transfer belt including only the belt base made of the hard material, transfer failure of toner occurs in the recesses of the uneven surface of the recording sheet even when the secondary-transfer bias including the superimposed voltage is applied to form an alternating electrical field in the secondary-transfer nip.

For this reason, the present inventors has performed the tests to secondarily transfer an image onto the sheet having an uneven surface ("LEATHAC 66") at an ultra-high speed (process linear velocity of 630 mm/s) for business users, using the printer test machine including an elastic belt as the intermediate transfer belt. This allows for a successful secondary transfer of toner into the recesses of the recording sheet having an uneven surface, thus effectively preventing the occurrence of the uneven image density due to the uneven surface of the sheet. This is considered to be because the elastic layer of the intermediate transfer belt that is the elastic belt is easily deformed, thereby reducing the distance between the surface of the intermediate transfer belt and the recesses of the sheet having an uneven surface. In view of the test results as described above, an elastic belt is used as the intermediate transfer belt 31 in the image forming apparatus according to the present embodiment.

Figure 4:
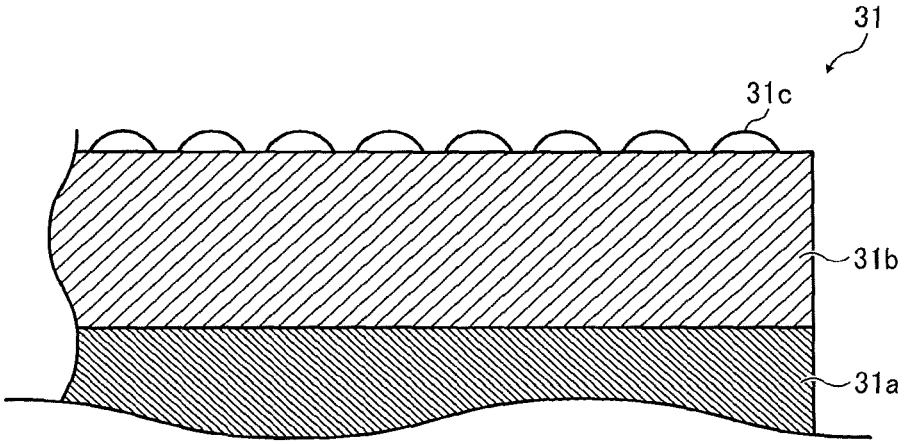
FIG. 4 is a partially enlarged cross-sectional view of an intermediate transfer belt employed in the image forming apparatus of FIG. 1.

FIG. 4 is a partially enlarged cross-sectional view of a transverse plane of the intermediate transfer belt 31 made of an elastic belt mounted on the image forming apparatus according the present embodiment. The intermediate transfer belt 31 includes a base layer 31*a* (belt base layer made of hard material) and an elastic layer 31*b*. The base layer 31*a* formed into an endless looped belt is formed of a material having a high stiffness, but having some flexibility. The elastic layer 31*b* disposed on the front surface of the base layer 31*a* is formed of an elastic material with high elasticity. Particles 31*c* are dispersed in the elastic layer 31*b*. While a portion of the particles 31*c* projects from the elastic layer 31*b*, the particles 31*c* are arranged concentratedly in a belt surface direction as illustrated in FIG. 4. With these particles 31*c*, an uneven surface of the belt with a plurality of bumps is formed on the intermediate transfer belt 31.

Examples of materials for the base layer 31*a* include, but are not limited to, a resin in which an electrical resistance adjusting material made of a filler or an additive is dispersed to adjust electrical resistance. Examples of the resin constituting the base layer 31*a* include, but are not limited to, fluorine-based resins such as ethylene tetrafluoroethylene copolymers (ETFE) and polyvinylidene fluoride (PVDF), and polyimide resins or polyamide-imide resins in terms of flame retardancy. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, and alkylbenzene sulfonate. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer 310, as needed. The coating solution is a liquid resin before curing in which electrical resistance adjusting materials are dispersed. An amount of the electrical resistance adjusting materials to be dispersed in the base layer 31*a* of a seamless belt, i.e., the intermediate transfer belt 31 is preferably in a range from 1×108 to 1×1013 Ω/sq in surface resistivity, and in a range from 1×106 to 1012 Ω·cm in volume resistivity. In terms of mechanical strength, an amount of the electrical resistance adjusting material to be added is determined such that the formed film is not fragile and does not crack easily. Preferably, a coating liquid, in which a mixture of the resin component (for example, a polyimide resin precursor and a polyamide-imide resin precursor) and the electrical resistance adjusting material are adjusted properly, is used to manufacture a seamless belt (i.e., the intermediate transfer belt) in which the electrical characteristics (i.e., the surface resistivity and the volume resistivity) and the mechanical strength are well balanced. The content of the electrical resistance adjusting material in the coating liquid when using carbon black is in a range from 10% through 25% by weight or preferably, from 15% through 20% by weight relative to the solid content. The content of the electrical resistance adjusting material in the coating liquid when using metal oxides is approximately 1% through 50% by weight or more preferably, in a range from 10% through 30% by weight relative to the solid content. If the content of the electrical resistance adjusting material is less than the above-described respective range, a desired effect is not achieved. If the content of the electrical resistance adjusting material is greater than the above-described respective range, the mechanical strength of the intermediate transfer belt (seamless belt) 31 drops, which is undesirable in actual use.

The thickness of the base layer 31*a* is not limited to a particular thickness and can be selected as needed. The thickness of the base layer 31*a* is preferably in a range from 30 μm to 150 μm, more preferably in a range from 40 μm to 120 μm, even more preferably, in a range from 50 μm to 80 μm. The base layer 31*a* having a thickness of less than 30 μm cracks and gets torn easily. The base layer 31*a* having a thickness of greater than 150 μm cracks when it is bent. By contrast, if the thickness of the base layer 31*a* is in the above-described respective range, the durability is enhanced.

In order to increase the stability of traveling of the intermediate transfer belt 31, preferably, the thickness of the base layer 31*a* is uniform as much as possible. An adjustment method to adjust the thickness of the base layer 31*a* is not limited to a particular method, and can be selected as needed. For example, the thickness of the base layer 31*a* can be measured using a contact-type or an eddy-current thickness meter or a scanning electron microscope (SEM) which measures a cross-section of the film.

As described above, the elastic layer 31*b* of the intermediate transfer belt 31 includes a plurality of raised portions with the particles 31*c* dispersed in the elastic layer 31*b*. Examples of elastic materials for the elastic layer 31*b* include, but arc not limited to, generally-used resins, elastomers, and rubbers. Preferably, elastic materials having good elasticity such as elastomer materials and rubber materials are used. Examples of the elastomer materials include, but are not limited to, polyesters, polyamides, polyethcrs, polyurethanes, polyolefins, polystyrenes, polyacrylics, polydiens, silicone-modified polycarbonates, and thermoplastic elastomers such as fluorine-containing copolymers. Alternatively, thermoplastic elastomer, such as fluorine-based copolymer thermoplastic elastomer, may be employed. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, and acrylic rubbers. Examples of rubber materials include, but are not limited to, chlorosulfonated polyethylenes, fluorocarbon rubbers, urethane rubbers, and hydrin rubbers. A material having desired characteristics can be selected from the above-described materials. In particular, in order to accommodate a recording sheet with an uneven surface such as Leathac (registered trademark), soft materials are preferable. Because the particles 31*c* are dispersed, thermosetting materials are more preferable than thermoplastic materials. The thermosetting materials have a good adhesion property relative to resin particles due to an effect of a functional group contributing to the curing reaction, thereby fixating reliably. For the same reason, vulcanized rubbers are also preferable.

In terms of ozone resistance, softness, adhesion properties relative to the particles, application of flame retardancy, environmental stability, and so forth, acrylic rubbers are most preferable among elastic materials for forming the elastic layer 31*b*. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents. Furthermore, examples of the aliphatic multivalent amine crosslinking agents include, but are not limited to, hexamethylenediamine, hexamethylenediamine carbamate, and N,N-dicinnamylidene-1,6-hexanediamine. Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene) dianiline, 4,4'-(p-phenylenediisopropylidene) dianiline, 2,2'-bis[4-(4-aminophenoxy)phenyl] propane, 4,4'-diaminobenzanilide, 4,4'-bis(4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range from 0.05 to 20 parts by weight, more preferably, from 0.1 to 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

In order to enhance a cross-linking reaction, a crosslinking promoter may be mixed in the acrylic rubber employed for the elastic layer 31*b*. The type of crosslinking promoter is not limited particularly. However, it is preferable that the crosslinking promoter can be used with the above-described multivalent amine crosslinking agents. Such crosslinking promoters include, but are not limited to, guanidino compounds, imidazole compounds, quaternary onium salts, tertiary phosphine compounds, and weak acid alkali metal salts. Examples of the guanidino compounds include, but are not limited to, 1,3-diphenylguanidine, and 1,3-di-o-tolylguanidine. Examples of the imidazole compounds include, but are not limited to, 2-methylimidazole and 2-phenylimidazole. Examples of the quaternary onium salts include, but are not limited to, tetra-n-butylammonium bromide and octadecyltri-n-butylammonium bromide. Examples of the multivalent tertiary amine compounds include, but are not limited to, triethylenediamine and 1,8-diazabicyclo[5.4.0]undec-7-ene (DBU). Examples of the tertiary phosphines include, but are not limited to, triphenylphosphine and tri(p-tolyl)phosphine. Examples of the weak acid alkali metal salts include, but are not limited to, phosphates such as sodium and potassium, inorganic weak acid salts such as carbonate or stearic acid salt, and organic weak acid salts such as lauric acid salt.

The amount of the crosslinking promoter is, preferably, in a range from 0.1 to 20 parts by weight, more preferably, from 0.3 to 10 parts by weight, relative to 100 parts by weight of the acrylic rubber. Too much crosslinking promoter causes undesirable acceleration of crosslinking during crosslinking, generation of bloom of the crosslinking promoter on the surface of crosslinked products, and hardening of the crosslinked products. By contrast, an insufficient amount of the crosslinking agent causes degradation of the tensile strength of the crosslinked products and a significant elongation change or a significant change in the tensile strength after heat load.

The acrylic rubber composition of the present disclosure can be prepared by an appropriate mixing procedure such as roll mixing, Banbury mixing, screw mixing, and solution mixing. The order in which the ingredients are mixed is not particularly limited. However, it is preferable that ingredients that are not easily reacted or decomposed when heated are first mixed thoroughly, and thereafter, ingredients that are easily reacted or decomposed when heated, such as a crosslinking agent, are mixed together in a short period of time at a temperature at which the crosslinking agent is neither reacted not decomposed.

When heated, the acrylic rubber serves as a crosslinked product. The heating temperature is preferably in a range of 130° C. through 220° C., more preferably, 140° C. through 200° C. The crosslinking time period is preferably in a range of 30 seconds through 5 hours. The heating methods can be chosen from those which are used for crosslinking rubber compositions, such as press heating, steam heating, oven heating, and hot-air heating. In order to reliably crosslink the inside of the crosslinked product, post crosslinking may be additionally carried out after crosslinking is carried out once. The post crosslinking time period varies depending on the heating method, the crosslinking temperature and the shape of crosslinked product, but is carried out preferably for 1 through 48 hours. The heating method and the heating temperature may be appropriately chosen. Electrical resistance adjusting agents for adjustment of electrical characteristics and flame retardants to achieve flame retardancy may be added to the selected materials. Furthermore, antioxidants, reinforcing agents, fillers, and crosslinking promoters may be added as needed. The electrical resistance adjusting agents to adjust electrical resistance can be selected from the above-described materials. However, since the carbon blacks and the metal oxides impair flexibility, it is preferable to minimize the amount of use. Ion conductive materials and conductive high polymers are also effective. Alternatively, these materials can be used in combination.

Preferably, various types of perchlorates and ionic liquids in an amount from about 0.01 parts by weight to 3 parts by weight are added, based on 100 parts by weight of rubber. With the ion conductive material in an amount 0.01 parts by weight or less, the resistivity is not reduced effectively. However, with the ion conductive material in an amount 3 parts by weight or more, it is highly possible that the conductive material blooms or bleeds to the belt surface.

The electrical resistance adjusting material to be added is in such an amount that the surface resistivity of the elastic layer 31*b* is, preferably, in a range from 1×108 Ω/sq to 1×1013 Ω/sq, and the volume resistivity of the elastic layer 31*b* is, preferably, in a range from 1×106 Ω·cm to 1×1012 Ω·cm.

The layer thickness of the elastic layer 31*b* is, preferably, in a range from 200 μm to 2 mm, more preferably, 400 μm to 1000 μm. The layer thickness less than 200 μm hinders deformation of the belt in accordance with the roughness (surface condition) of the recording sheet and a transfer-pressure reduction effect. By contrast, the layer thickness greater than 2 mm causes the elastic layer 31*b* to sag easily due to its own weight, resulting in unstable movement of the intermediate transfer belt 31 and damage to the intermediate transfer belt 31 looped around rollers. The layer thickness can be measured by observing the cross-section of the elastic layer 31*b* using a scanning electron microscope (SEM), for example.

The particle 31*c* to be dispersed in the elastic material of the elastic layer 31*b* is a spherical resin particle having an average particle diameter of equal to or less than 100 μm and is insoluble in an organic solvent. Furthermore, the 3% thermal decomposition temperature of these resin particles is equal to or greater than 200° C. The resin material of the particle 31*c* is not particularly limited, but may include acrylic resins, melamine resins, polyamide resins, polyester resins, silicone resins, fluorocarbon resins, and rubbers. Alternatively, in some embodiments, surface processing with different material is applied to the surface of the particle made of resin materials. A surface of a spherical mother particle made of rubber may be coated with a hard resin. Furthermore, the mother particle may be hollow or porous.

Among such resins mentioned above, the silicone resin particles are most preferred because the silicone resin particles provide good slidability, separability relative to toner, and wear and abrasion resistance. Preferably, the spherical resin particles are prepared through a polymerization process. The more spherical the particle is, the more preferred. Preferably, the volume average particle diameter of the particle is in a range from 1.0 μm to 5.0 μm, and the particle dispersion is monodisperse with a sharp distribution. The monodisperse particle is not a particle with a single particle diameter. The monodisperse particle is a particle having a sharp particle size distribution. More specifically, the distribution width of the particle is equal to or less than±(Average particle diameter×0.5 μm). With the particle diameter of the particle 31*c* less than 1.0 μm, enhancement of transfer performance by the particle 31*c* is not achieved sufficiently. By contrast, with the particle diameter greater than 5.0 μm, the space between the particles increases, which results in an increase in the surface roughness of the intermediate transfer belt 31. In this configuration, toner is not transferred well, and the intermediate transfer belt 31 is not cleaned well. In general, the particle 31*c* made of resin material has a relatively high insulation property. Thus, if the particle diameter is too large, accumulation of electrical charges of the particle diameter 31*c* during continuous printing causes image defect easily.

Either commercially-available products or laboratory-derived products may be used as the particle 31*c*. The thus-obtained particle 31*c* is directly applied to the elastic layer 31*b* and evened out, thereby evenly distributing the particle 31*c* with ease. With this configuration, an overlap of the particles 31*c* in the belt thickness direction is reduced, if not prevented entirely. Preferably, the cross-sectional diameter of the plurality of particles 31*c* in the surface direction of the elastic layer 31*b* is as uniform as possible. More specifically, the distribution width thereof is equal to or less than± (Average particle diameter×0.5 μm). For this reason, preferably, powder including particles with a small particle diameter distribution is used as the particles 31*c*. If the particles 31*c* having a specific particle diameter can be applied to the elastic layer 31*b* selectively, it is possible to use particles having a relatively large particle diameter distribution. It is to be noted that timing at which the particles 31*c* are applied to the surface of the elastic layer 31*b* is not particularly limited. The particles 31*v* can be applied before or after crosslinking of the elastic material of the elastic layer 31*b*.

Preferably, a projected area ratio of a portion of the elastic layer 31*b* having the particles 31*c* relative to the elastic layer 31*b* with its surface being exposed is equal to or greater than 60% in the surface direction of the elastic layer 31*b*. In a case in which the projected area ratio is less than 60%, the frequency of direct contact between toner and the pure surface of the elastic layer 31*b* increases, thereby degrading transferability of toner, cleanability of the belt surface from which toner is removed, and filming resistance. In some embodiments, a belt without the particles 31*c* dispersed in the elastic layer 31*b* can be used as the intermediate transfer belt 31.

As illustrated in FIG. 4, no particles 31*c* overlapping each other are observed on the surface of the intermediate transfer belt 31. Preferably, the cross-sectional diameters of the plurality of particles 31*c* in the surface of the elastic layer 31*b* are as uniform as possible. More specifically, the distribution width thereof is preferably equal to or less than±(Average particle diameter×0.5 μm). For this reason, preferably, powder including particles with a small particle diameter distribution is used as the particles. If the particles 31*c* having a specific particle diameter can be selectively localized in the elastic layer 31*b*, power including particles with a large particle diameter distribution may be used.

When paper having an uneven surface, such as Japanese paper called "Washi" is used as a recording sheet P, an elastic layer 31*b* having good elasticity is used to successfully secondarily transfer toner onto recesses of the recording sheet P, which prevents uneven image density due to the uneven surface. However, such an elastic layer 31*b* is not practical because the elastic layer 31*b* easily elongates after being stretched out. This is because, the elastic layer 31*b* includes a base layer 31*a* having more rigidity than the elastic layer 31*b*, which suppresses the elongation of the entire belt over a long time period.

As described above, the image forming apparatus 1000 according to the first embodiment employs the intermediate transfer belt 31 that is an elastic belt including the base layer 31*a* and the elastic layer 31*b* laminated on the base layer 31*a*. This allows for a successful secondary transfer of a sufficient amount of toner into the recesses of the recording sheet having an uneven surface, thus effectively preventing the occurrence of the uneven image density due to the uneven surface of the sheet even at the ultra-high speed (process linear velocity of 630 mm/s) for business users.

Figure 6:
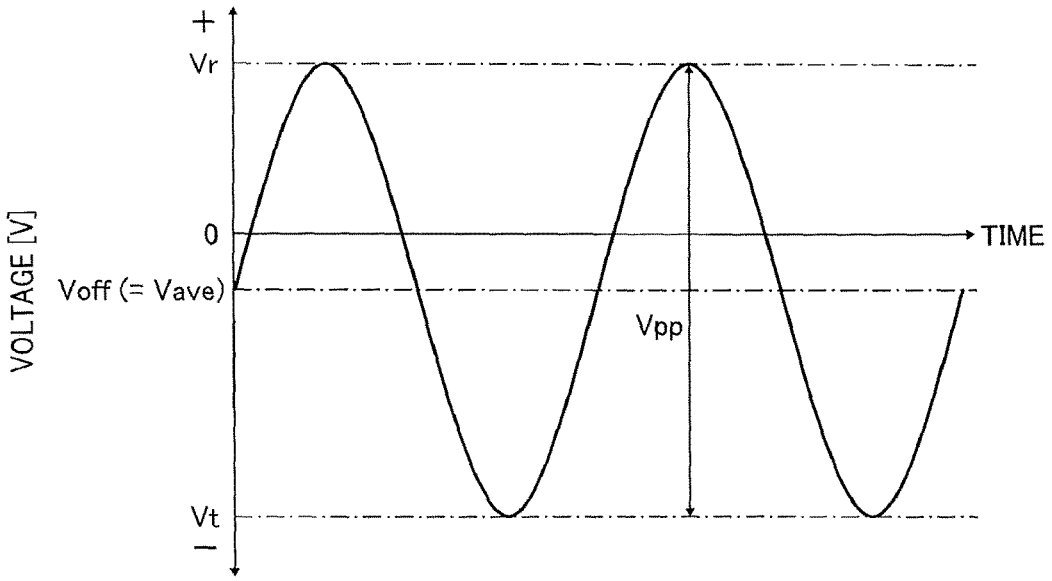
FIG. 6 is a graph of a waveform of a secondary-transfer bias including a superimposed voltage with an opposite-peak duty of 50% according to an embodiment of the present disclosure.

FIG. 6 is a waveform chart as an example of a secondary-transfer bias including the superimposed voltage output from the secondary-transfer power source 39. In FIG. 6, the waveform of the secondary-transfer bias is sinusoidal. The offset voltage Voff is a value of the DC component (DC voltage) of the secondary-transfer bias including the superimposed voltage. The offset voltage Voff is negative in polarity in FIG. 6. When the waveform of the secondary-transfer bias is sinusoidal as illustrated in FIG. 6, the offset voltage Voff is the same as the average potential Vave for one cycle (T) of the secondary-transfer bias. That is, the average potential Vave is also negative in polarity in FIG. 6.

As in the image forming apparatus 1000 according to the present embodiment in which the secondary-transfer bias is applied to the metal core of the secondary-transfer first roller 33 (FIG. 1), the toner electrostatically moves in the transfer direction in the secondary-transfer nip N when the polarity of the secondary-transfer bias is the same as the normal charge polarity of toner. More specifically, the toner electrostatically moves from the surface of the intermediate transfer belt 31 onto the surface of the recording sheet in the secondary-transfer nip N. When the polarity of the secondary-transfer bias becomes opposite to the normal charge polarity of toner, the toner electrostatically moves in the direction opposite to the transfer direction within the secondary-transfer nip N. More specifically, the toner electrostatically moves from the surface of the recording sheet P onto the surface of the intermediate transfer belt 31 in the secondary-transfer nip N. In the present embodiment, the average potential Vave is made negative that is the same as the normal charge polarity of toner to reciprocally move toner between the surface of the intermediate transfer belt 31 and the surface of the recording sheet P within the secondary-transfer nip N. Thus, the toner relatively moves from the surface of the intermediate transfer belt 31 onto the surface of the recording sheet P. This allows for a successful secondary transfer of a toner image from the surface of the intermediate transfer belt 31 onto the surface of the recording sheet P.

In FIG. 6, a transfer peak value Vt is one of two peak values of one cycle (cycle T) of the secondary transfer bias. The secondary transfer bias with the transfer peak value Vt electrostatically moves toner from the surface of the intermediate transfer belt 31 toward the surface of the recording sheet P with a greater force. A peak value Vr is the other peak value of the two peak values. In other words, the peak value Vr is an opposite-peak value to the transfer peak value Vt. In the secondary-transfer bias of FIG. 6, the opposite-peak value Vr is an opposite polarity (positive polarity) to the polarity of the transfer peak value Vt.

Figure 7:
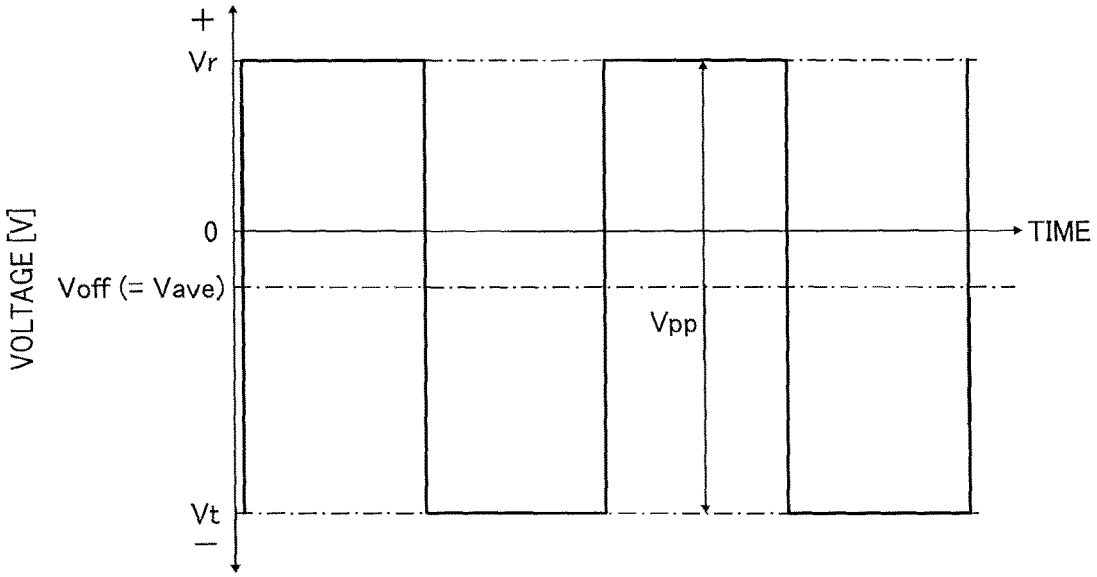
FIG. 7 is a graph of a waveform of a secondary-transfer bias including the superimposed voltage with an opposite-peak duty of 50% according to another embodiment of the present disclosure.

The waveform of the secondary-transfer bias is not limited to the sinusoidal wave as illustrated in FIG. 6. Alternatively, any of a triangular wave and a rectangular wave of the secondary transfer bias is applicable. FIG. 7 is a waveform chart of the secondary-transfer bias including the superimposed voltage as a second example. In FIG. 7, the waveform of the secondary-transfer bias is rectangular. Each of the sinusoidal wave of the secondary-transfer bias in FIG. 6 and the rectangular wave of the secondary-transfer bias in FIG. 7 has a duty ratio of 50% on the opposite-peak side to be described below. Any secondary-transfer bias having the waveform with such characteristics has the average potential Vave that is the same as the offset voltage Voff for one cycle (cycle T). In other words, the value of the DC component is the same as the average potential Vave.

Figure 8:
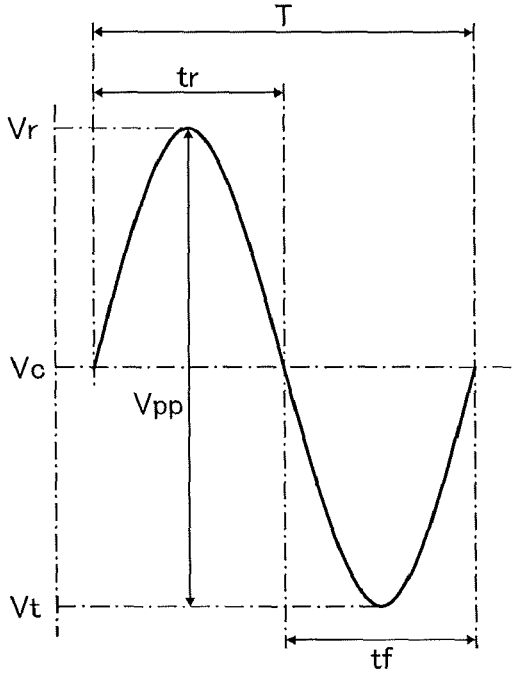
FIG. 8 is a graph for describing the opposite-peak duty of the secondary-transfer bias of FIG. 6.

FIG. 8 is a graph for describing the duty ratio on the opposite-peak side of the secondary-transfer bias of FIG. 6. In FIG. 8, a center potential Vc is a potential in the middle of a peak-to-peak value Vpp of the AC component (AC voltage) of the secondary-transfer bias. A time period tr on the opposite-peak side (the opposite-peak time period tr) is a time period from a time when the value of the secondary-transfer bias starts rising from the center potential Vc toward the opposite-peak value Vr to a time when the value having reached the opposite-peak value Vr returns to the center potential Vc within one cycle (cycle T). In FIG. 8, a time period tf on the transfer-peak side (the transfer-peak time period tf) is a time period from a time when the value of the secondary-transfer bias starts rising from the center potential Vc toward the transfer-peak value Vt to a time when the value having reached the transfer-peak value Vt returns to the center potential Vc within one cycle (cycle T). The duty on the opposite-peak side (the opposite-peak duty) is a ratio of the opposite-peak time period tr in the cycle T. In the case of the waveform in FIG. 8, the duty ratio is 50%. In other words, the waveform of FIG. 8 has an opposite-peak duty of 50%.

Figure 9:
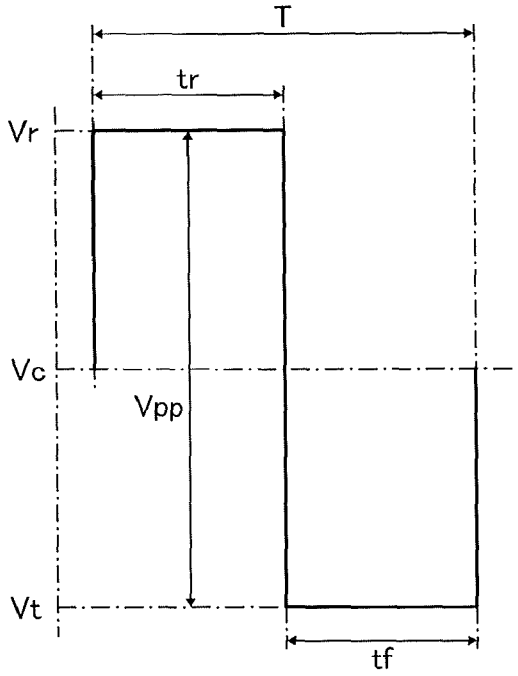
FIG. 9 is a graph for describing the opposite-peak duty of the secondary-transfer bias of FIG. 7.

FIG. 9 is a graph for describing the opposite-peak-side duty of the secondary-transfer bias of FIG. 7. In the rectangular wave of FIG. 7 as well, the opposite-peak duty is 50% as a ratio of the opposite-peak time period tr in the cycle T.

To electrostatically move toner from the surface of the intermediate transfer belt 31 onto the surface of the recording sheet P within the secondary-transfer nip N with the secondary-transfer bias having an opposite-peak duty of 50%, the absolute value of the transfer-peak value Vt is preferably greater than the absolute value of the opposite-peak value Vr. With an excessively increased absolute value of the transfer-peak value Vt, electric discharge occurs within the secondary-transfer nip N between the surface of the intermediate transfer belt 31 and the sheet having an uneven surface. Such an electric discharge causes toner particles to be charged with the opposite polarity, thereby hampering the secondary transfer of the toner particles. As a result, many white spots occur in the image, and thus the image quality significantly degrades. Accordingly, the absolute value of the transfer-peak value Vt is preferably set to a certain value.

With an excessively reduced absolute value of the opposite-peak value Vr, a sufficient amount of toner fails to be transferred to the recesses of the sheet having an uneven surface. More specifically, with an excessively reduced absolute value of the opposite-peak value Vr, the toner particles having been temporarily transferred to the recesses of the sheet fail to return to the surface of the intermediate transfer belt in the secondary-transfer nip. Accordingly, the toner particles fails to return from the recesses of the sheet and collide with other toner particles adhering to the surface of the intermediate transfer belt, thus failing to reduce the adhesion force between the other toner particles and the surface of the intermediate transfer belt. Thus, the toner particles to be transferred into the recesses of the sheet fail to increase in number by merely vibrating the toner particles. As a result, an insufficient amount of toner is transferred into the recesses of the sheet.

Examples of the methods for increasing the opposite-peak value Vr include increasing the peak-to-peak value Vpp of the AC component. Increasing the peak-to-peak value Vpp to prevent the insufficient opposite-peak value Vr, however, increases the transfer-peak value Vt as well, which increases the possibility of the occurrence of white spots due to the electric discharge.

Alternatively, the offset value Voff is reduced to increase the opposite-peak value Vr. Reducing the offset value Voff reduces the average potential Vave, and thereby the toner fails to electrostatically move from the surface of the intermediate transfer belt onto the surface of the sheet, resulting in the secondary transfer failure.

To transfer a sufficient amount of toner into the recesses of the sheet having an uneven surface, the opposite-peak duty is preferably less than or equal to 50%, and more preferably less than 50%. With the opposite-peak duty of greater than 50%, the white spots due to the electric discharge and the secondary transfer failure occur. More specifically, with the opposite-peak duty of greater than 50%, the average potential Vave is shifted toward the opposite-peak side by the amount that exceeds the duty of 50% to reduce the absolute value of the average potential Vave, resulting in the occurrence of the secondary transfer failure. To avoid such a secondary transfer failure, if the peak-to-peak vale Vpp is increased to increase the average potential Vave, the transfer-peak value Vt increases, thereby increasing the possibility of occurrence of white spots due to the electric discharge. Thus, the opposite-peak duty is preferably less than or equal to 50%.

Figure 10:
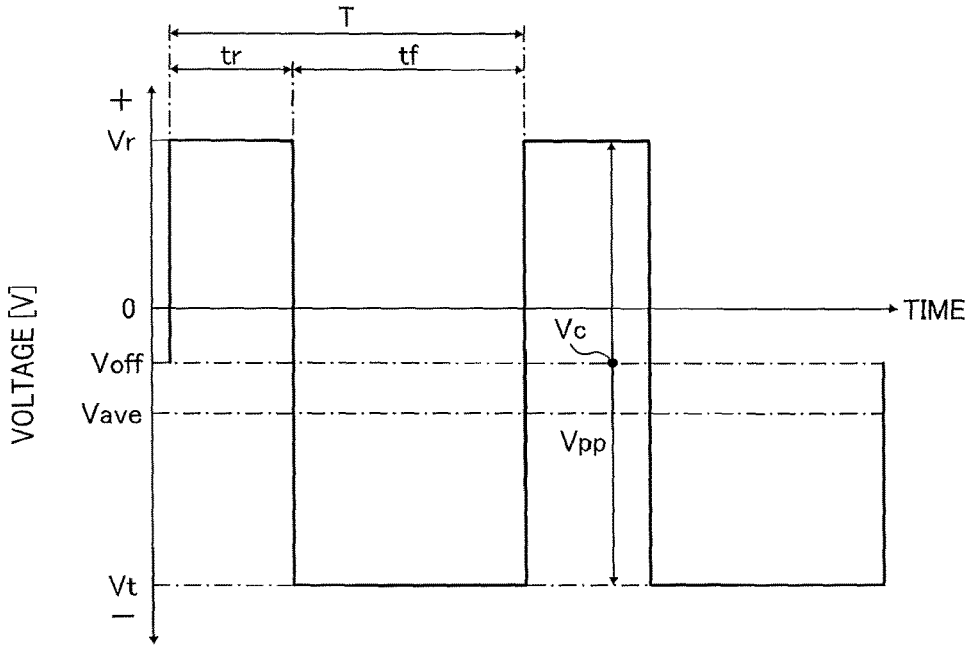
FIG. 10 is a graph of a waveform of a secondary-transfer bias having an opposite-peak duty of 35% according to an embodiment of the present disclosure.

FIG. 10 is a graph of a waveform of a secondary-transfer bias including the superimposed voltage with an opposite-peak duty of 35% that is less than 50% according to an embodiment of the present disclosure. The opposite-peak value Vr of the secondary-transfer bias in FIG. 10 is the same as the opposite-peak value Vr of the secondary-transfer bias in FIG. 7. The transfer-peak value Vt of the secondary-transfer bias in FIG. 10 is the same as the transfer-peak value Vt of the secondary-transfer bias in FIG. 7. The secondary-transfer bias in FIG. 10 differs from the secondary-transfer bias in FIG. 7 in the opposite-peak time period tr and the transfer-peak time period tf. In the secondary-transfer bias of FIG. 7, the opposite-peak time period tr is the same as the transfer-peak time period tf. By contrast, in the secondary-transfer bias of FIG. 10, the opposite-peak time period tr is shorter than the transfer-peak time period tf. More specifically, in the secondary-transfer bias of FIG. 7, the length of the opposite-peak time period tr is 50% of the cycle T. By contrast, in the secondary-transfer bias of FIG. 10, the opposite-peak time period tr is 35% of the cycle T. In other words, the secondary-transfer bias in FIG. 10 has an opposite-peak duty of 35%. In the secondary-transfer bias of FIG. 7 having an opposite-peak duty of 50%, the offset voltage Voff is the same as the average potential Vave as described above. In the secondary-transfer bias of FIG. 10 having an opposite-peak duty of 35%, the average potential Vave is greater than the offset voltage Voff. The peak-to-peak value Vpp is common between the secondary-transfer bias in FIG. 7 and the secondary-transfer bias in FIG. 10. That is, with the opposite-peak duty of less than 50%, the average potential Vave successfully increases without any changes in the peak-to-peak value Vpp, the transfer-peak value Vt, and the opposite-peak value Vr as compared to the case of the opposite-peak duty of 50%. Thus, with the opposite-peak duty of less than 50%, the secondary transfer failure and the occurrence of white spots are prevented or reduced as compared to the case of the opposite-peak duty of greater than or equal to 50%.

Accordingly, the image forming apparatus according to the first embodiment employs the secondary-transfer bias that reverses the polarity thereof during one cycle and has an opposite-peak duty of less than 50% when a toner image is secondarily transferred onto the sheet having an uneven surface (the uneven surface sheet). Such a configuration successfully prevents or reduces the secondary transfer failure and the occurrence of white spots due to the electrical discharge as compared to cases in which the secondary-secondary transfer bias has an opposite-peak duty of greater than or equal to 50%. Hereinafter, the property that the opposite-peak duty is less than 50% is referred to as low duty. The property that the opposite-peak duty is greater than 50% is referred to as high duty.

Figure 11:
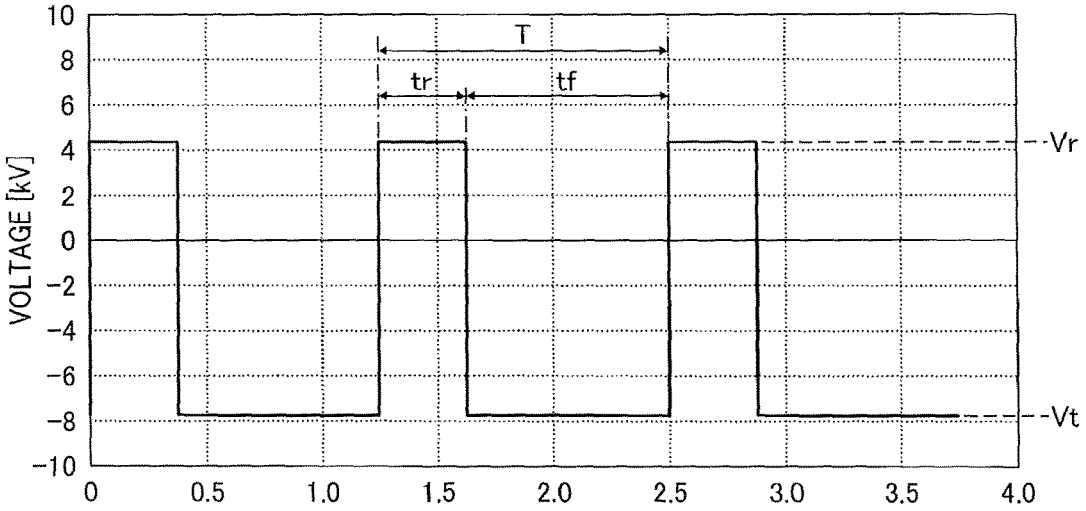
FIG. 11 is a graph of a waveform of a secondary-transfer bias having an opposite-peak duty of 30% (low duty) according to an embodiment of the present disclosure.
Figure 12:
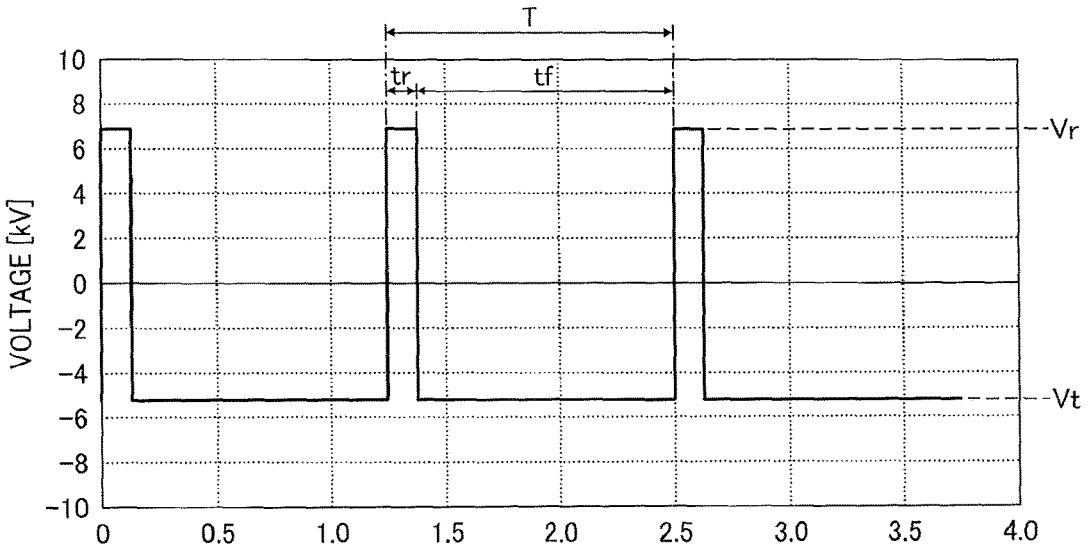
FIG. 12 is a graph of a waveform of a secondary-transfer bias having an opposite-peak duty of 10% (low duty) according to an embodiment of the present disclosure.

Note that with a significantly reduced value of the opposite-peak duty in the secondary-transfer bias having the low duty, the absolute value of the opposite-peak value Vr increases as compared to the absolute value of the transfer-peak value Vt. FIG. 11 for example is a graph of a waveform of the secondary-transfer bias having the low duty in which the opposite-peak duty is 30% according to an embodiment. FIG. 12 is a graph of a waveform of the secondary-transfer bias having the low duty in which the opposite-peak duty is 10% according to an embodiment. In each of the secondary-transfer biases of FIGS. 11 and FIG. 12, the average potential Vave is −4 kV and the peak-to-peak value Vpp is 12 kV. In the secondary-transfer bias having the opposite-peak duty of 30% in FIG. 11, the absolute value (over 4) of the opposite-peak value Vr is smaller than the absolute value (under 8) of the transfer-peak value Vt. In the secondary-transfer bias having the opposite-peak duty of 10% in FIG. 12, the absolute value (under 7) of the opposite-peak value Vr is greater than the absolute value (over 5) of the transfer-peak value Vt.

With the secondary-transfer bias of FIG. 11 in which the transfer-peak value Vt is greater than the opposite-peak value Vr (in terms of absolute value), the electrical discharge occurs in the secondary-transfer nip during the transfer-peak time period tf in which the value of the secondary-transfer bias is the transfer-peak value Vt in one cycle, thus increasing the possibility of occurrence of white spots in an image. By contrast, with the secondary-transfer bias in FIG. 12, the opposite-peak value Vr is greater than the transfer-peak value Vt (in terms of absolute value). Accordingly, the electrical discharge occurs in the secondary-transfer nip during the opposite-peak time period tr in which the value of the secondary-transfer bias is the opposite-peak value Vr in one cycle, thus increasing the possibility of occurrence of white spots in an image. The absolute value (under 7) of the opposite-peak value Vr of the secondary-transfer bias in FIG. 12 is smaller than the absolute value (under 8) of the transfer-peak value Vt of the secondary-transfer bias in FIG. 11. The opposite-peak time period tr of the secondary-transfer bias in FIG. 12 is shorter than the transfer-peak time period tf of the secondary-transfer bias in FIG. 11. In other words, the absolute value of a peak value (the opposite-peak value Vr) that induces the occurrence of white spots in the secondary-transfer bias in FIG. 12 is smaller than the absolute value of the peak value (the transfer-peak value Vt) in the secondary-transfer bias in FIG. 11. The duration (the opposite-peak time period tr) of the peak value of the secondary-transfer bias in FIG. 12 is shorter than the duration (the transfer-peak time period tt) of the peak value of the secondary-transfer bias in FIG. 11. Accordingly, the secondary-transfer bias in FIG. 12 is more likely to induce the occurrence of white spots due to the electrical discharge than the secondary-transfer bias in FIG. 11. Thus, when the secondary-transfer bias having the low duty is employed to secondarily transfer an image onto an uneven surface sheet, it is preferable that the value of the opposite-peak duty is significantly reduced. According to the experiment performed by the present inventors, it has been found that the opposite-peak duty preferably ranges from 8% through 35% and more preferably ranges from 8% through 17% to prevent or reduce the occurrence of white spots. However, with a significantly reduced opposite-peak duty, the ratio of the opposite-peak time period tr in one cycle T significantly reduces. This might fail to bring toner particles in the recesses of the uneven surface sheet back to the surface of the intermediate transfer belt during the opposite-peak time period tr. Accordingly, it is preferable that the frequency of the AC component is relatively reduced and the length of one cycle T is relatively increased to obtain a sufficient length of the opposite-peak time period tr.

The present inventors have performed the experiment in which a halftone image is secondarily transferred onto a recording sheet P that is a coated sheet with a good surface smoothness under the conditions that the secondary-transfer bias having the low duty is used and that the secondary-transfer bias including only the DC voltage is used. The results have indicated that an insufficient image density occurs in a halftone image due to secondary transfer failure.

With respect to such a secondary transfer failure, the present inventors have recognized the following. The entire printed area of the halftone image is not covered with toner. The printed area includes toner-adhesion spots that constitute relatively few-dot groups and a white space to which no toner adheres. The intermediate transfer belt 31 including the elastic layer 31*b* is used and a smooth sheet having a good surface smoothness is used as the recording sheet P. In this case, the elastic layer 31*b* flexibly deforms in conformity with the shapes of the few-dot toner masses (toner masses of few dots) each of which constitutes the few-dot group in the halftone image within the secondary-transfer nip N. The elastic layer 31*b* deforms to cover the surfaces as well as the side surfaces of the few-dot toner masses. This injects charges having the opposite polarity of the normal charge polarity into the toner particles of the few-dot toner masses, thereby reducing the charge amount of toner (Q/M) or causing the toner to be charged with the opposite polarity. It has been found that this results in the secondary transfer failure of a toner image. Note that when the uneven surface sheet is used as the recording sheet P, the elastic layer 31*b* deforms into irregular shapes in conformity with the unevenness of the uneven surface sheet, thereby leading to little possibility of covering the side surfaces of the few-dot toner masses by the elastic layer 31*b*. Thus, no secondary transfer failure occurs on the protrusions of the uneven surface sheet as well.

Figure 13:
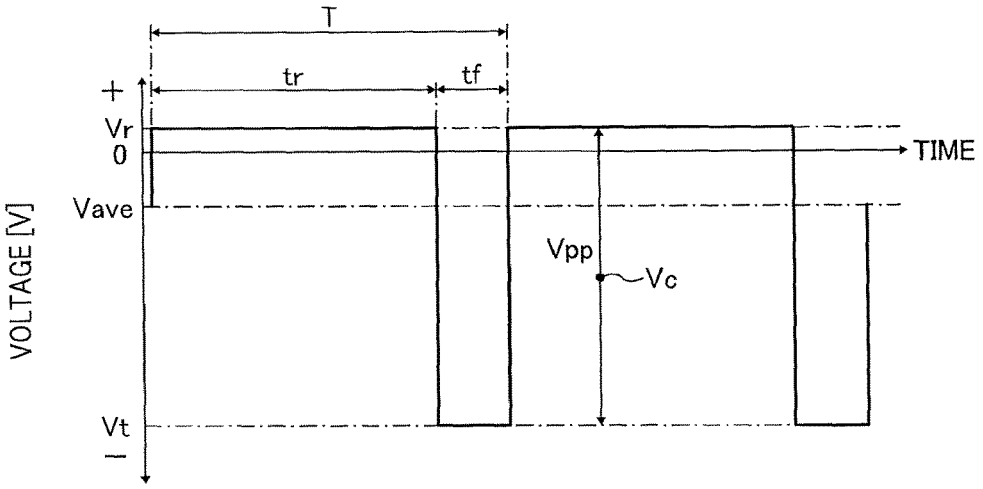
FIG. 13 is a graph of a waveform of a secondary-transfer bias having an opposite-peak duty of 80% (high duty) in which the polarity is reversed during one cycle according to an embodiment of the present disclosure.

Next, the present inventors have performed the experiment in which an image is secondarily transferred onto a smooth sheet using the secondary-transfer bias having the high duty (the opposite-peak duty is 80%) in FIG. 13 is used instead of the secondary-transfer bias having the low duty and the secondary-transfer bias including only the DC voltage. As the smooth sheet, OK Top Coat (so-called coated paper) from Oji paper Co., Ltd., having a weight of 128 gsm is used. In the experiment, a black halftone image (2 by 2) has been secondarily transferred onto the smooth sheet under the conditions that the temperature is 27° C., the humidity is 80%, and the process linear velocity is 630 mm/s. The results have indicated that the black halftone image is secondarily transferred onto the smooth sheet in a successful manner without the secondary transfer failure.

The reason why secondary transferability of the black halftone image relative to the smooth sheet was improved by using the secondary-transfer bias including the high duty is as follows. When the intermediate transfer belt 31 that endlessly moves enters the secondary-transfer nip N, the secondary-transfer bias starts charging a portion of the intermediate transfer belt 31 that has entered the secondary-transfer nip N. When the amount of charge exceeds the threshold value, charges having the opposite polarity start to be injected into the few-dot toner masses in the halftone image. The portion of the intermediate transfer belt 31 having entered the secondary-transfer nip N is charged during the transfer-peak time period tf. Accordingly, with an increase in length of the transfer-peak time period tf, the amount of injection of the charges having the opposite polarity into the few-dot toner masses increases. The secondary-transfer bias having the high duty has a shorter transfer-peak time period tf than the secondary-transfer bias having the low duty. Accordingly, it is conceivable that the secondary-transfer bias having the high duty reduces the amount of injection of the charges having the opposite polarity into the few-dot toner masses, thereby preventing or reducing the occurrence of the secondary transfer failure.

Figure 14:
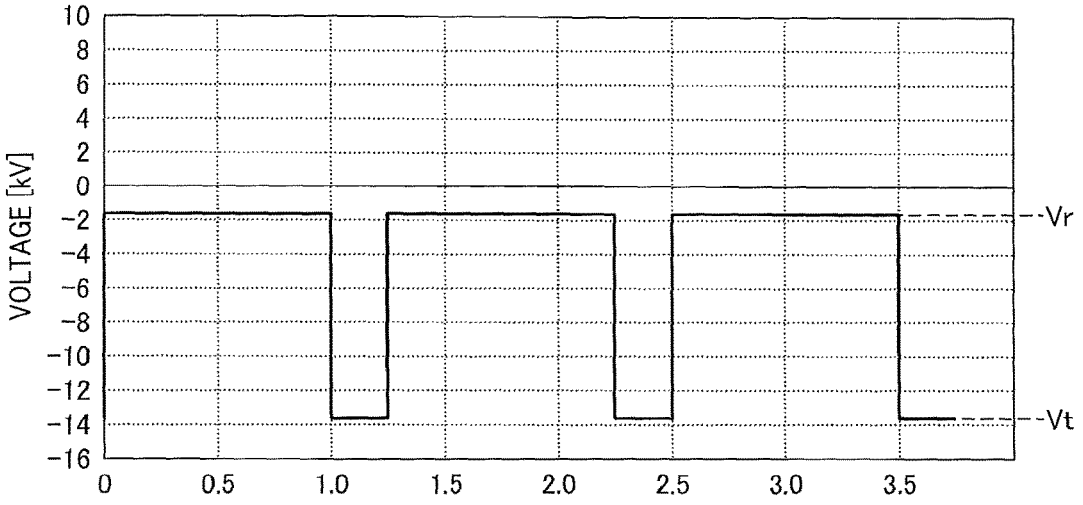
FIG. 14 is a graph of a waveform of a secondary-transfer bias having an opposite-peak duty of 80% (high duty) in which the polarity is constant during the one cycle, the average potential is −4 kV and the peak-to-peak potential Vpp is 12 kV according to an embodiment of the present disclosure.
Figure 15:
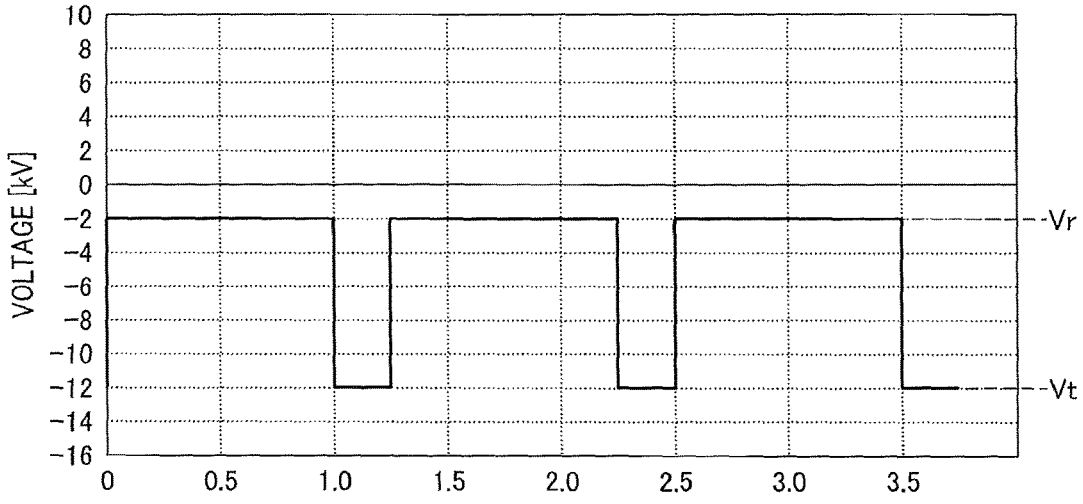
FIG. 15 is a graph of a waveform of a secondary-transfer bias having an opposite-peak duty of 80% (high duty) in which the polarity is constant during the one cycle, the average potential is −4 kV and the peak-to-peak potential Vpp is 10 kV according to an embodiment of the present disclosure.
Figure 16:
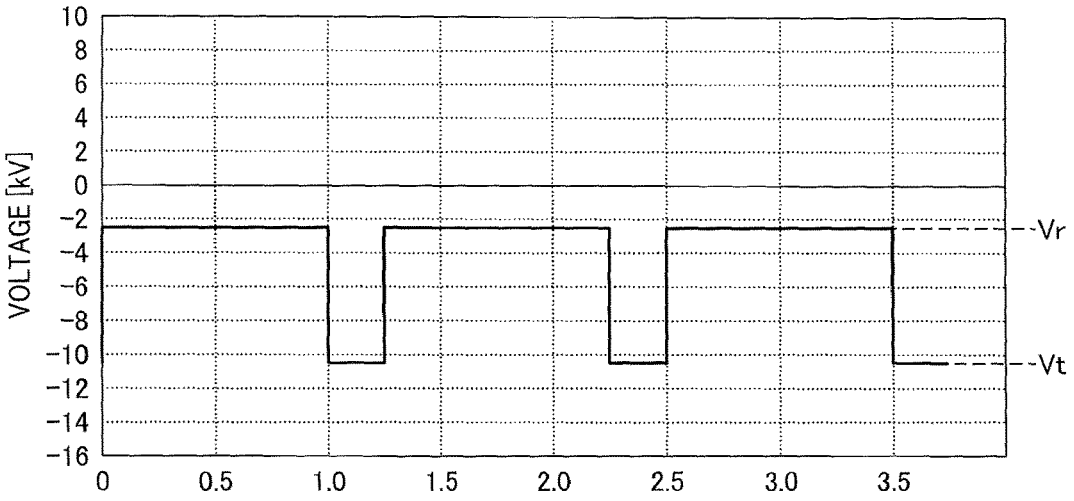
FIG. 16 is a graph of a waveform of a secondary-transfer bias having an opposite-peak duty of 80% (high duty) in which the polarity is constant during the one cycle, the average potential is −4 kV and the peak-to-peak potential Vpp is 8 kV according to an embodiment of the present disclosure.
Figure 17:
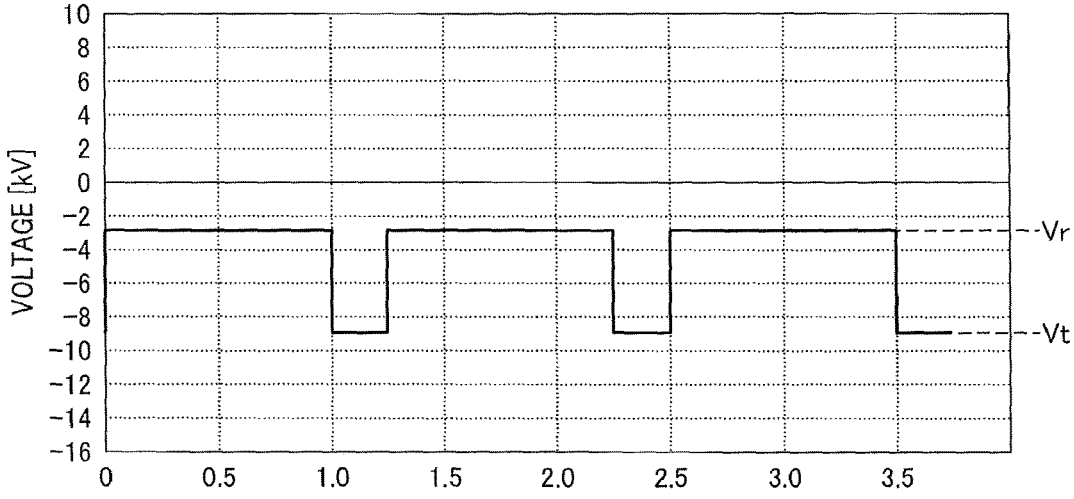
FIG. 17 is a graph of a waveform of a secondary-transfer bias having an opposite-peak duty of 80% (high duty) in which the polarity is constant during the one cycle, the average potential is −4 kV and the peak-to-peak potential Vpp is 6 kV according to an embodiment of the present disclosure.

Another experiment performed by the present inventors has indicated as follows. The use of the secondary-transfer bias having the high duty in FIG. 14 though FIG. 17 that does not reverse the polarity during one cycle improves the secondary transferability relative to the smooth sheet as compared to the use of the secondary-transfer bias having the high duty in FIG. 13 that reverses the polarity during one cycle.

In the secondary-transfer bias in FIG. 13, the polarity of the voltage is changed to the polarity opposite to the polarity of the transfer-peak time period tf during the opposite-peak time period tr, to reverse the direction of the electrical field to bring toner from the surface of the sheet back to the surface of the intermediate transfer belt. Each of the secondary-transfer bias in FIG. 13 and the secondary-transfer bias in FIG. 14 through FIG. 17 has the same opposite-peak duty and the same intensity integral value (Vave) of the secondary-transfer electrical field in one cycle to obtain the similar secondary transferability. In this case, the transfer-peak value Vt of the secondary-transfer bias in FIG. 13 is preferably greater than the transfer-peak value Vt of the secondary-transfer bias in FIG. 14 through FIG. 17. Accordingly, with the secondary-transfer bias in FIG. 13, the amount of injection of charges having the opposite polarity into the few-dot toner masses in the halftone image increases as compared to the secondary-transfer bias in FIG. 14 through FIG. 17. In other words, the secondary-transfer bias in FIG. 14 through FIG. 17 allows a reduction in transfer-peak value Vt, thereby reducing the amount of injection of charges having the opposite polarity into the few-dot toner masses, thus improving the secondary transferability as compared to the secondary-transfer bias in FIG. 13.

In the secondary-transfer biases in FIG. 14 through FIG. 17, the opposite-peak duty is 80% and the average potential Vave is −4 kV. However, the peak-to-peak potential Vpp differs between the secondary-transfer biases of FIG. 14 through FIG. 17. To achieve differing peak-to-peak potentials Vpp and the common opposite-peak duty and average potential Vave between the secondary-transfer biases of FIG. 14 through FIG. 17, the secondary-transfer biases of FIG. 14 through FIG. 17 have different offset voltage Voff from each other. The peak-to-peak potentials Vpp of the secondary-transfer biases of FIG. 14, FIG. 15, FIG. 16, and FIG. 17 are 12 kV, 10 kV, 8 kV, and 6 kV, respectively. With such values of the peak-to-peak potentials Vpp, the transfer-peak value Vt of the secondary-transfer bias gradually decreases in order of FIG. 14, FIG. 15, FIG. 16, and FIG. 17. The opposite-peak value Vr of the secondary-transfer bias gradually increases in order of FIG. 14, FIG. 15, FIG. 16, and FIG. 17. In FIG. 14, FIG. 15, FIG. 16, and FIG. 17, the polarity of the opposite-peak value Vr is the same as the polarity of the transfer-peak value Vt. Focusing attention on the polarity, charges having the opposite polarity might be injected into the few-dot toner masses in the halftone image during the opposite-peak time period tr as well. However, the opposite-peak value Vr is relatively low in each of FIG. 14 through FIG. 17, and therefore there is little possibility of charges having the opposite polarity being injected into the few-dot toner masses during the opposite-peak time period tr. Using the secondary-transfer bias in FIG. 17 in which the transfer-peak value Vt that mainly causes the injection of the charges having the opposite polarity into the few-dot toner masses in the transfer-peak time period tf is the greatest among FIG. 14 through FIG. 17, the secondary transferability relative to the smooth sheet increases the best among FIG. 14 through FIG. 17.

Note that in the secondary-transfer bias including only the DC voltage and having the average potential Vave of −4 kV that is the same as those of FIG. 14 through FIG. 17, the charges having the opposite polarity are injected into the few-dot toner masses all the time during one cycle. This is because the value of −4 kV exceeds the threshold value that starts injecting the charges having the opposite polarity from the intermediate transfer belt 31 into the few-dot toner masses. Thus, the secondary transferability significantly occurs.

The following Table 1-1 and Table 1-2 indicate the results of the experiment performed by the present inventors.

TABLE 1

| TEST CONDITIONS/TEST NUMBER | | | 1 | 2 | 3 |
|---|---|---|---|---|---|
| SHEET | UNEVEN SHEET | LEATHAC 66 260 kg | LOW DUTY RANK 4 | LOW DUTY RANK 5 | LOW DUTY RANK 5 |
| | | LEATHAC 66 215 kg | LOW DUTY RANK 5 | LOW DUTY RANK 5 | LOW DUTY RANK 5 |
| | | LEATHAC 66 175 kg | LOW DUTY RANK 5 | LOW DUTY RANK 5 | LOW DUTY RANK 5 |
| | SMOOTH SHEET | OK Top Coat | HIGH DUTY 90% | HIGH DUTY 75% | HIGH DUTY 60% |
| MICRO-RUBBER HARDNESS OF BELT | | | 80 | 60 | 50 |

| TEST CONDITIONS/TEST NUMBER | | | 4 | 5 | |
|---|---|---|---|---|---|
| SHEET | UNEVEN SHEET | LEATHAC 66 260 kg | LOW DUTY RANK 5 | LOW DUTY RANK 5 | BIAS Transferability in Recesses |
| | | LEATHAC 66 215 kg | LOW DUTY RANK 5 | LOW DUTY RANK 5 | BIAS Transferability in Recesses |
| | | LEATHAC 66 175 kg | LOW DUTY RANK 5 | LOW DUTY RANK 5 | BIAS Transferability in Recesses |
| | SMOOTH SHEET | OK Top Coat | HIGH DUTY 50% | DC Only 10% | BIAS HT Transfer Ratio |
| MICRO-RUBBER HARDNESS OF BELT | | | 40 | 40 | |

In Table-1, LEATHAC 66 (registered trademark) is an uneven surface sheet manufactured by TOKUSHU TOKAI PAPER CO., LTD., having a greater degree of recess in the uneven surface with an increase in basis weight. That is, the degree of recess in the uneven surface decreases in order of the basis weights of 260 kg, 215 kg, and 175 kg. The OK Top Coat having a weight of 128 gsm is a coated surface sheet (smooth sheet) manufactured by Oji paper Co., Ltd.

In the present experiment, a blue solid image in which magenta and cyan colors are superimposed was secondarily transferred onto an uneven surface sheet, and a black halftone image (2 by 2) was secondarily transferred onto a smooth sheet.

In Table-1 and Table-2, the transferability in the recesses refers to the transferability of toner relative to the recesses of the surface of the uneven surface sheet. The transferability in the recesses was evaluated based on the image quality in the recesses of the surface of the uneven surface sheet. The transferability is evaluated on 5-point scales ranging from 1 through 5 in which grade 5 is the highest. More specifically, the case in which a sufficient amount of toner is transferred onto the recesses of the surface and the recesses and the protrusions of the surface rarely differ in image quality from each other is evaluated as grade 5. Grade 4 is assigned for the case in which one of magenta toner and cyan toner slightly decreases in amount of transfer as compared to the other of the magenta toner and the cyan toner, and thus an insufficient color tone is recognized in two through three recesses having greater degrees of recess among the plurality of recesses in the uneven surface. Grade 3 is assigned for the case in which a white void is recognized in the two through three recesses having greater degrees of recess. The case in which white voids are scattered over the plurality of recesses is evaluated as grade 2 (such scattering whit voids were not found in the experiment of Table 1-1 and Table 1-2). Grade 1 is assigned for the case in which white voids are recognized in almost all of the recesses (such whit voids were not found in the experiment of Table 1-1 and Table 1-2).

An HT transfer rate that is a transfer rate of the black halftone image relative to the smooth sheet was measured as follows. First, when a halftone image is primarily transferred onto the intermediate transfer belt 31, a test machine is stopped and a vacuum collects the black-color toner of the halftone image from the intermediate transfer belt 31 to measure the weight of the collected toner as the total weight. Next, the halftone image is primarily transferred onto the intermediate transfer belt 31 under the same conditions as the previous primary transfer, and the primarily-transferred halftone image is secondarily transferred onto a smooth sheet immediately thereafter. Then, the test machine is stopped immediately after the secondary transfer, and the vacuum collects the untransferred residual toner on the intermediate transfer belt 31 to measure the weight of the collected residual toner as the amount of untransferred residual toner (sometimes referred to simply as residual toner). The HT transfer rate is obtained by a solution of "(the total weight−residual toner)/the total amount×100".

The micro-rubber hardness (micro hardness) is obtained by measuring the hardness of a portion cut off from the intermediate transfer belt 31 using Micro rubber hardness mether MD-1 (registered trademark) produced by KOBUNSHI KEIKI CO., LTD. Specifically, a needle is pressed (indented) toward the portion of the intermediate transfer belt 31 with a predetermined pressing force at a temperature of 23° C. and a humidity of 50%, and the hardness of the intermediate transfer belt 31 is calculated based on the depth of indentation of the needle while deforming the portion of the intermediate transfer belt 31.

In all of Experiments 1 through 5, the secondary-transfer bias including the superimposed voltage with the low duty was used to secondarily transfer a solid image onto the uneven surface sheet. In Experiments 1 through 4, the secondary-transfer bias including the superimposed voltage with the high duty in which the polarity is not reversed was used to secondarily transfer a halftone image onto the smooth sheet. In Experiment 5, the secondary-transfer bias including only the DC voltage is used to secondarily transfer the halftone image onto the smooth sheet in a manner different from the manner in the first embodiment.

As can be found from the results of Experiment 1 through 4, with an increase in elasticity of the intermediate transfer belt 31 (with a reduction in hardness), the transferability in recesses of the uneven surface sheet increases. By contrast, with an increase in elasticity of the intermediate transfer belt 31, the HT transfer rate unsuccessfully decreases. To balance the transferability with the HT transfer rate in recesses, the micro-rubber hardness of the intermediate transfer belt 31 is preferably less than 100 and more preferably ranges from 50 through 80. Accordingly, the image forming apparatus according to the present embodiment employs the intermediate transfer belt 31 with the micro-rubber hardness adjusted to be within the above-described ranges.

Note that, as can be found from Experiment 5, when the secondary transfer bias including only the DC voltage is used to secondarily transfer a halftone image onto the smooth sheet, the HT transfer rate significantly decreases (10%). This is because the charges having the opposite polarity are injected into the few-dot toner masses in the halftone image.

Figure 18:
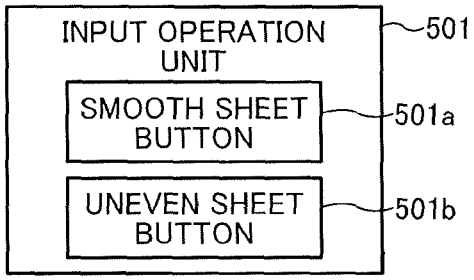
FIG. 18 is a block diagram of electrical circuitry of an input operation unit of the image forming apparatus of FIG. 1.

FIG. 18 is a block diagram of electrical circuitry of an input operation unit 501 of the image forming apparatus according to the first embodiment of the present disclosure. As illustrated in FIG. 18, the input operation unit 105 includes a smooth sheet button 501*a* (a first button) and an uneven sheet button 501*b* (a second button). In the image forming apparatus according to the first embodiment, a description is given in the instruction manual for uses to operate as follows. That is, when a high-smooth sheet (a first type sheet) having a good surface smoothness (an enhanced surface smoothness), such as a coated sheet, as a recording sheet P is set in the sheet tray 100 of FIG. 1, the smooth sheet button 501*a* is depressed. By contrast, when a low-smooth sheet (a second type sheet) that is inferior in surface smoothness (less surface smoothness), such as a regular paper or Japanese paper, as a recording sheet P is set in the sheet tray 100, the uneven sheet button 501*b* is depressed. That is, the input operation unit 501 functions as an information acquisition unit that acquires the following information. Specifically, the specific information includes information capable of specifying whether a recording sheet P, onto which the toner image is to be secondarily transferred, is the high-smooth sheet having a higher surface smoothness (a good surface smoothness) or the low-smooth sheet having a lower surface smoothness (an inferior surface smoothness) than the surface smoothness of the high-smooth sheet.

The power-source controller 200 as a controller switches a transfer mode between a high-smooth mode (a first mode) to secondarily transfer a toner image onto the high-smooth sheet and a low-smooth mode (a second mode) to secondarily transfer a toner image onto the low-smooth sheet based on the information acquired by the input operation unit 501. More specifically, when the smooth sheet button 501*a* is depressed, the power-source controller 200 switches the transfer mode to the high-smooth mode. In the high-smooth mode, the secondary-transfer power source 39 outputs the secondary-transfer bias having the high duty to prevent or reduce the injection of the charges having the opposite polarity into the few-dot toner masses in a secondary transfer of the halftone image onto the smooth sheet. In the secondary-transfer bias used in the high-smooth mode, the polarity is constantly negative (is not reversed), and the opposite-peak duty ranges from 70% to 90%.

When the uneven sheet button 501*b* is depressed, the power-source controller 200 switches the transfer mode to the low-smooth mode. In the low-smooth mode, the secondary-transfer power source 39 outputs the secondary-transfer bias having the low duty to secondarily transfer a sufficient amount of toner into the recesses of the uneven surface sheet. The secondary-transfer bias has the following properties. The secondary-transfer bias reverses the polarity between the negative polarity and the positive polarity during one cycle. In the negative polarity, the polarity of the average potential Vave and the polarity of the transfer peak value Vt are negative in which the direction of the electrical field is in the transfer direction. In the positive polarity, the polarity of the opposite-peak value Vr is positive in which the direction of the electrical field is opposite to the transfer direction. In addition, the opposite-peak duty ranges from 8% to 17%.

Such a configuration, in which the secondary-transfer power source 39 outputs the secondary-transfer bias having the low duty with the use of the low-smooth sheet, such as a regular paper or Japanese paper, as the recording sheet, exhibits the following effects. The toner particles favorably reciprocate in the secondary transfer nip between the recesses of the recording sheet P and the surface of the intermediate transfer belt 31, thereby transferring a sufficient amount of toner onto the recesses of the recording sheet P, thus preventing or reducing the occurrence of unevenness in image density in conformity with the uneven surface. Thus, with the opposite-peak duty being low duty, the occurrence of white spots due to the electrical discharge is prevented or reduced.

Such a configuration, in which the secondary-transfer power source 39 outputs the secondary-transfer bias having the low duty with the use of the low-smooth sheet, such as a regular paper or Japanese paper, as the recording sheet, exhibits the following effects. With the opposite-peak duty being the high duty, the injection of the charges having the opposite polarity into the few-dot toner groups of the halftone image is prevented or reduced, thereby increasing the secondary transferability of the halftone image relative to the smooth sheet. Thus, the occurrence of insufficient image density of the halftone image is prevented.

Note that, the case in which the secondary-transfer bias having the high duty is used in the high-smooth mode and the secondary-transfer bias having the low duty is used in the low-smooth mode is described above. Alternatively, the following case is available. The secondary-transfer bias having the opposite-peak duty of 50% is used in the high-smooth mode and the secondary-transfer bias having the low duty in the low-smooth mode. Alternatively, the secondary-transfer bias having the high duty is used in the high-smooth mode and the secondary-transfer bias having the opposite-peak duty of 50% in the low-smooth mode.

Next, descriptions are given below of the image forming apparatus according to Variation in which the configuration of a part of the image forming apparatus according to the first embodiment is modified into a different configuration, and of the image forming apparatuses according to Examples in which the configuration of a part of the image forming apparatus according to the first embodiment includes additional distinctive feature. Furthermore, the configurations of the image forming apparatuses according to Variation and Examples arc the same as in the first embodiment unless otherwise stated.

[Variation]

In the image forming apparatus 1000 according to Variation, the input operation unit 105 does not include the smooth sheet button 501*a* and the uneven sheet button 501*b*. The image forming apparatus 1000 according to Variation is not designed to allow a user to input information regarding the surface smoothness of the recording sheet. Instead, the image forming apparatus 1000 according to Variation includes a smoothness sensor to detect the surface smoothness of the recording sheet.

Figure 19:
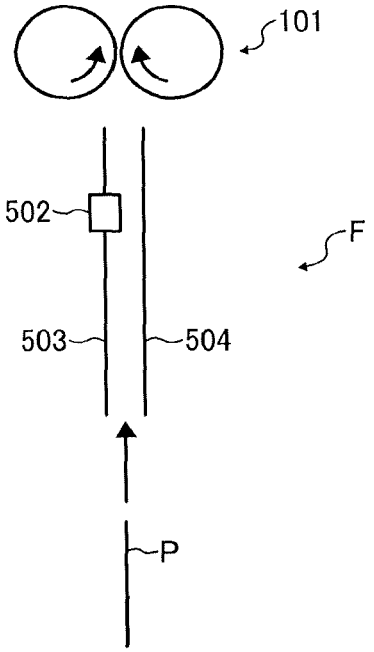
FIG. 19 is a schematic view of a feeding path of the image forming apparatus according to Variation.

FIG. 19 is a schematic view of a feeding path F of the image forming apparatus 1000 according to Variation. The feeding path F guides a recording sheet P interposed between a first guide plate 503 and a second guide plate 504 to a registration nip of the registration rollers 101. The first guide plate 503 includes a through hole in which a smoothness sensor is disposed. The smoothness sensor 502 including a reflective optical sensor outputs light emitted from light emitting elements toward a recording sheet P in the feeding path and receives the light totally reflected from the surface of the recording sheet P at light receiving elements. The amount of totally-reflected light that is obtained by the surface of the smooth sheet, such as a coated sheet, is greater than the amount of totally-reflected light that is obtained by the surface of the uneven surface sheet, such as Japanese paper.

The smoothness sensor 502 is connected to the power-source controller 200. The power-source controller 200 calibrates the smoothness sensor 502 in a start up of the image forming apparatus immediately after the main power source of the image forming apparatus is turned on. More specifically, the power-source controller 200 adjusts the amount of light emission (supply voltage) of the light emitting elements to obtain a predetermined amount of totally-reflected light in a state that the light emitting elements emit light and the emitted light is reflected by the surface of the second guide plate 504 that is white colored. In this case, a supply voltage value is preliminarily stored in a memory. The smoothness sensor 502 supplies a voltage with the same value as the supply voltage value preliminarily stored in the memory to the light emitting elements to detect the amount of totally-reflected light on the surface of the recording sheet P.

When a print job is started, the recording sheet P fed out from the sheet tray 100 at a predetermined timing comes in contact with the registration nip of the registration rollers 101 that is not driven, and thereby the conveyance of the sheet is stopped for skew adjustment. In such case, the recording sheet P faces the smoothness sensor 502 in the feeding path F. In this state, the power-source controller 200 controls the smoothness sensor 502 to detect the amount of totally-reflected light on the surface of the recording sheet P The smoothness sensor 502 is connected to the power-source controller 200. When the detection result exceeds a threshold value, the power-source controller 200 determines that the recording sheet P is a smooth sheet and thereby performs the above-described high-smooth mode. When the detection result fails to exceed the threshold value, the power-source controller 200 determines that the recording sheet P is an uneven surface sheet and thereby performs the above-described low-smooth mode.

In such a configuration, the power-source controller 200 automatically obtains information regarding whether the recording sheet P to be conveyed to the secondary-transfer nip N is the smooth sheet (high-smooth sheet) or the uneven surface sheet (low-smooth sheet) without any operation of a user, thus increasing the operability of users.

FIRST EXAMPLE

Figure 20:
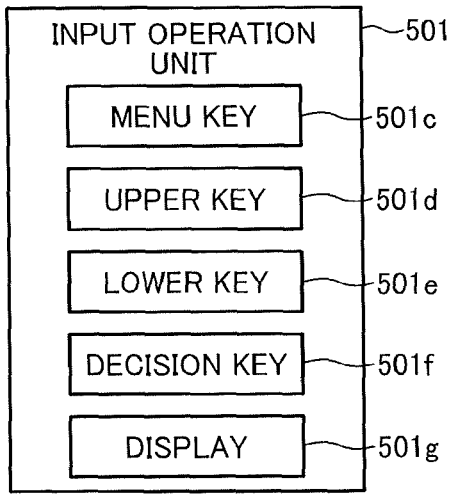
FIG. 20 is a block diagram of electrical circuitry of an input operation unit of the image forming apparatus according to a first Example of the present disclosure.

FIG. 20 is a block diagram of electrical circuitry of an input operation unit 501 of the image forming apparatus according to a first Example of the present disclosure. The input operation unit 105 does not include the smooth sheet button 501*a* and the uneven sheet button 501*b* unlike in the first embodiment. Instead, the input operation unit 105 includes a menu key 501*c*, an upper key 501*d*, a lower key 501*e*, a decision key 501*f*, and a display 501*g*.

When a user presses the menu key 501*c*, the main controller allows the display 501*g* to display a menu screen. The user operates the upper key 501*d* or the lower key 501*e* to align a cursor on a desired menu among a plurality of menus displayed in the menu screen and press the decision key 501*f* so as to select the menu. When the user selects the "Input Type of Sheet" menu through the operation of keys, the main controller allows the display 501*g* to display a list of sheet brands. The user may select, through the operation of the upper key 501*d* and the lower key 501*e*, the same brand as the brand of the recording sheet that is set in the sheet tray 100 among a plurality of brands included in the list. The brand and the surface smoothness of the recording sheet of the brand have one-to-one relation between each other. Thus, the brand serves as information that represents the surface smoothness.

The main controller stores, in a data memory, a data table in which the brands and the numerical values of the opposite-peak duty are associated with each other. The numerical values of the opposite-peak duty that represent high duty are set for the brand of the smooth sheet. The numerical values of the opposite-peak duty that represent low duty are set for the brand of the uneven surface sheet. In terms of the brand of the uneven surface sheet, with an increase in degree of unevenness of the uneven surface sheet, the numerical value of the opposite-peak duty decreases. When the user selects a brand through the operation of the menu, the main controller identifies, from the data table, the numerical value of the opposite-peak duty corresponding to the brand. Then, the main controller sends the result to the power-source controller 200. The power-source controller 200 having received the numerical value of the opposite-peak duty from the main controller controls the secondary-transfer power source 39 to output the secondary-transfer bias having the same numerical value of the opposite-peak duty as the numerical value sent from the main controller. Accordingly, when the brand of the smooth sheet is selected, the power-source controller 200 performs the high-smooth mode. When the brand of the uneven surface sheet is selected, the power-source controller 200 performs the low-smooth mode.

Such a configuration increases the secondary-transfer efficiency of the halftone image relative to the protrusions of the uneven surface sheet or increases the amount of transfer of toner relative to the recesses of the uneven surface sheet in the low-smooth mode, as compared to the case in which the value of the opposite-peak duty is constant. More specifically, with uneven surface sheet, with a reduction in degree of unevenness of the uneven surface sheet, the area of protrusion increases, thereby increasing the possibility of injecting the charges having the opposite polarity into the few-dot toner masses in the halftone image in the protrusions of the uneven surface sheet. With an increase in degree of unevenness of the uneven surface sheet, the degree (size and depth) of recess in the uneven surface increases, and thereby the transfer failure of toner relative to the recesses of the uneven surface is more likely to occur. To handle such a circumstance, with an increase in degree of unevenness of the uneven surface sheet, the value of the opposite-peak duty is reduced. This allows transferring a sufficient amount of toner onto the recesses of the uneven surface sheet having a relatively high degree of unevenness of the uneven surface sheet. In addition, a halftone image is secondarily transferred onto the protrusions of the uneven surface sheet having a relatively low degree of unevenness in the uneven surface sheet in a successful manner.

Note that the maximum unevenness difference may be used as an index that represents the degree of the sheet surface unevenness. In addition, examples of a commercially available device of the measurement device that measures the maximum unevenness difference include "SURFCOM 1400D" (manufactured by TOKYO SEIMITSU CO., LTD.). In the measurement device, five sites in the entire region of a surface are randomly selected as a region to be inspected on the basis of an image that is obtained by photographing the surface of a recording sheet with a microscope. With respect to the respective sites, the maximum cross-sectional height (Pt) (JIS B 0601:2001) of a cross-sectional curve is measured under conditions in which an evaluation length is set to 20 mm and a reference length is set to 20 mm. In addition, an average value of top three heights among five maximum cross-sectional heights Pt, which are obtained, is obtained. The above-described processes are performed with respect to each of the front end portion, the central portion, and the rear end portion of the recording sheet P, and an average of respective average values is obtained as the maximum unevenness difference. For example, a recording sheet P of which the maximum unevenness difference (specific information) is 50 μm or greater may be specified as an uneven surface sheet (low-smooth sheet), and a recording sheet P of which the maximum unevenness difference is less than 50 μm may be specified as a recording sheet having a smooth surface (high-smooth sheet).

SECOND EXAMPLE

The present inventors have performed another experiment of printing a test image with different frequency, peak-to-peak value Vpp, and DC voltage value (target current value under constant current control) of the secondary-transfer bias. In the low-smooth mode, a black solid image was secondarily transferred onto the uneven surface sheet (i.e., LEATHAC 66). In the high-smooth mode, a blue halftone image (2 by 2) was secondarily transferred onto the OK Top Coat (smooth sheet) having a weight of 128 gsm. The results are represented in Table 2.

TABLE 2

| TEST CONDITIONS/TEST NUMBER | | | 6 | 7 | |
|---|---|---|---|---|---|
| SHEET | UNEVEN SHEET | LEATHAC 66 260 kg | LOW DUTY RANK 5 | LOW DUTY RANK 4 | BIAS Transferability in Recesses |
| | | LEATHAC 66 215 kg | LOW DUTY RANK 3.5 | LOW DUTY RANK 5 | BIAS Transferability in Recesses |
| | | LEATHAC 66 175 kg | LOW DUTY RANK 4 | LOW DUTY RANK 5 | BIAS Transferability in Recesses |
| | SMOOTH SHEET | OK Top Coat | HIGH DUTY 90% | HIGH DUTY 60% | BIAS HT Transfer Ratio |
| MICRO-RUBBER HARDNESS OF BELT | | | 80 | 80 | |

As represented in Table 2, the intermediate transfer belt 31 having a micro-rubber hardness of 80 was used in both Experiment 6 and Experiment 7. As can be found from the results of Experiment 1 in Table 1-1 and Table 1-2, the used of such an intermediate transfer belt 31 exhibits a favorable transferability in recesses. However, the transferability in recesses might decrease depending on the properties of the secondary-transfer bias.

In Experiment 6, the peak-to-peak potential Vpp is 5 kV, the frequency is 104 kHz, and the target current value of the DC component is −80 μA. The opposite-peak duty is 13% in the low-smooth mode (the uneven surface sheet) and 80% in the high-smooth mode (the smooth sheet).

In Experiment 7, the peak-to-peak potential Vpp is 12 kV, the frequency is 0.8 kHz, and the target current value of the DC component is −100 μA. The opposite-peak duty is 13% in the low-smooth mode (the uneven surface sheet) and 80% in the high-smooth mode (the smooth sheet).

In terms of the low-smooth mode (the uneven surface sheet), the transferability in recesses is more favorable in Experiment 7 than in Experiment 6. This is because of the following two reasons. The first reason is the difference in frequency. Under the condition of the low duty, the opposite-peak time period tr is shorter than the transfer-peak time period tf, and thereby the time period of returning the toner particles from the recesses of the uneven surface sheet to the surface of the intermediate transfer belt 31 is more likely to be insufficient. With an increase in frequency, the possibility of occurrence of such an insufficient time period of returning toner remarkably increases. The frequency in Experiment 6 is higher than in Experiment 7. Accordingly, the opposite-peak time period tr in Experiment 6 is shorter than the opposite-peak time period tr in Experiment 7 even when the same opposite-peak duty of 13% in Experiment 6 is the same as in Experiment 7. With such an increase in amount of toner particles that fail to return to the surface of the intermediate transfer belt 31 from the recesses of the uneven surface sheet, the capability to reduce the adhesion force of the toner particles onto the surface of the intermediate transfer belt 31 decreases, thus degrading the transferability of toner onto the recesses of the uneven surface sheet.

The second reason is the difference in peak value Vpp. Under the condition of the low duty, the peak-to-peak value Vpp is preferably increased to some degree to prevent the insufficient amount of the opposite-peak value Vr to successfully return the toner particle to the surface of the intermediate transfer belt 31 from the recesses of the uneven surface sheet. The peak-to-peak value Vpp in Experiment 6 is smaller than the peak-to-peak value Vpp in Experiment 7. Accordingly, the opposite-peak value Vr is slightly insufficient in Experiment 6.

In terms of the high-smooth mode (the smooth sheet), the HT transferability is more favorable in Experiment 6 than in Experiment 7. This is because of the following two reasons. The first reason is the differences in peak-to-peak value Vpp and target current value of the DC component. The peak-to-peak value Vpp in Experiment 6 is less than the half of the peak-to-peak value Vpp in Experiment 7. In addition, the target current value of the DC component in Experiment 6 is smaller than that of Experiment 7. As a result, the transfer-peak value Vt in Experiment 6 is smaller than the transfer-peak value in Experiment 7, and thus the injection of the charges having the opposite polarity into toner is less likely to occur in Experiment 6. In addition, unlike in Experiment 7, the polarity remains negative in Experiment 6, and thus the injection of the charges having the opposite polarity is less likely to occur.

The second reason is the difference in frequency. The charges having the opposite polarity are injected into toner during the opposite-peak time period tf in the high-smooth mode. In the opposite-peak time period tf, the amount of injection of charges having the opposite polarity into toner per unit time increases, and reaches a level of saturation after the certain time period passes. Accordingly, as the opposite-peak time period tf relatively reduces, the amount of injection of charges having the opposite polarity into toner during the pass through the secondary-transfer nip decreases as compared to the case in which the opposite-peak time period tf is relatively increased. The frequency in Experiment 6 is higher than in Experiment 7. Accordingly, the opposite-peak time period tf in Experiment 6 is shorter than the opposite-peak time period tf in Experiment 7 even when the opposite-peak duty is 80% in Experiment 6. For this reason, the amount of injection of the charges having the opposite polarity into toner in Experiment 6 is less than in Experiment 7.

As can be found from the above-described experimental results, the frequency in the high-smooth mode is preferably higher than the frequency in the low-smooth mode. This configuration increases the HT transferability in the high-smooth mode, and further increases the transferability in recesses in the low-smooth mode.

Further, the peak-to-peak value Vpp in the high-smooth mode is preferably lower than the peak-to-peak value Vpp in the low-smooth mode. This configuration increases the HT transferability in the high-smooth mode, and further increases the transferability in recesses in the low-smooth mode.

With an excessively increased the transfer-peak value Vt or the opposite-peak value Vr, electric discharge occurs within the secondary-transfer nip N between the surface of the intermediate transfer belt 31 and the surface of the sheet, thereby leading to the occurrence of many white spots due to the electric discharge. However, the transfer-peak value Vt or the opposite-peak value Vr is preferably increased to some degree in the low-smooth mode (the uneven surface sheet) to reciprocate toner particle between the surface of the intermediate transfer belt and the recesses of the uneven surface sheet in the secondary transfer nip. Such a configuration increases the image quality rather than failing to obtain a favorable transferability in recesses with the occurrence of a slight amount of white spots. By contrast, in the high-smooth mode (smooth sheet), the secondary-transfer bias having the high duty, in which the polarity is not reversed, may be used because the polarity of the secondary-transfer bias does not have to be reversed to reciprocate toner. This increases the HT transferability, and further reduces the transfer-peak value Vt (that is greater than the opposite-peak value Vr because the polarity is not reversed), thus preventing or reducing the occurrence of white spots. To reverse the polarity, the peak-to-peak value Vpp and the target current value of the DC component are respectively reduced as compared to those of the secondary-transfer bias having the low duty.

In view of the above, the power-source controller 200 controls the secondary-transfer power source 39 to output the secondary-transfer bias having a greater frequency, a lower peak-to-peak value Vp, and a greater DC voltage value (target current value) in the high-smooth mode than those in the low-smooth mode.

Next, description will be given of an image forming apparatus according to a second embodiment of the present disclosure. Note that the image forming apparatus according to the second embodiment includes additional distinctive feature relative to the image forming apparatus according to the first embodiment. Furthermore, the configuration of the image forming apparatus according to the second embodiment is the same as in the first embodiment unless otherwise stated.

Figure 21:
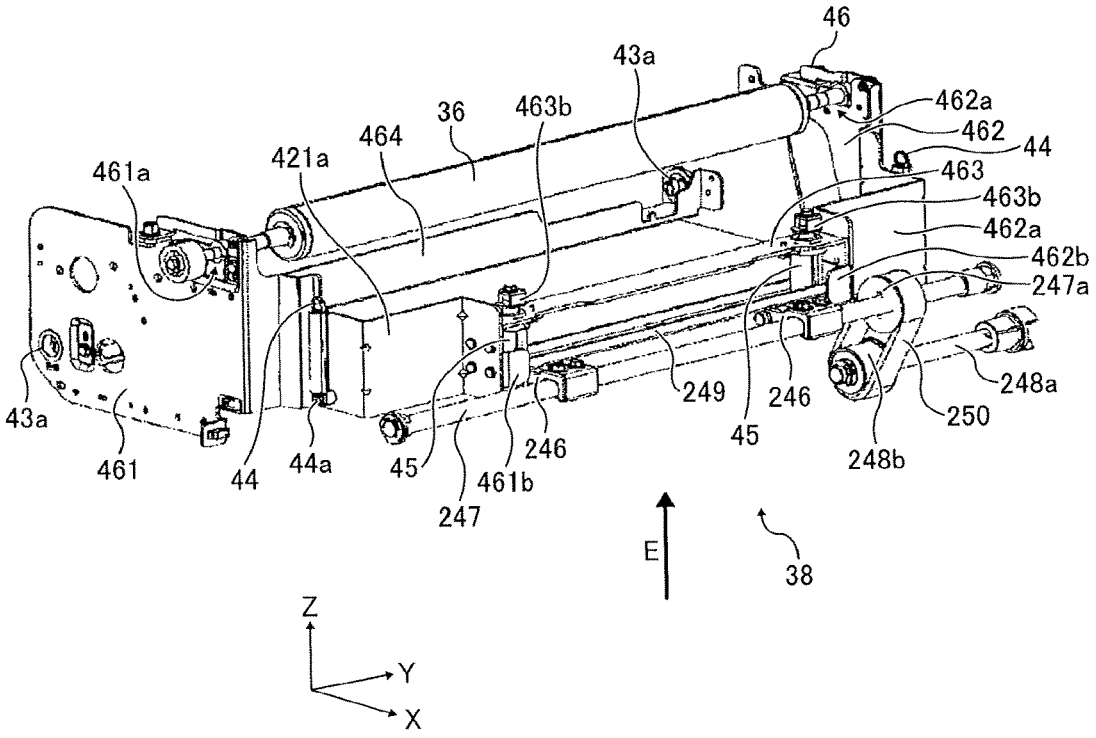
FIG. 21 is a perspective view of a sheet conveyor unit of an image forming apparatus according to a second embodiment.
Figure 22:
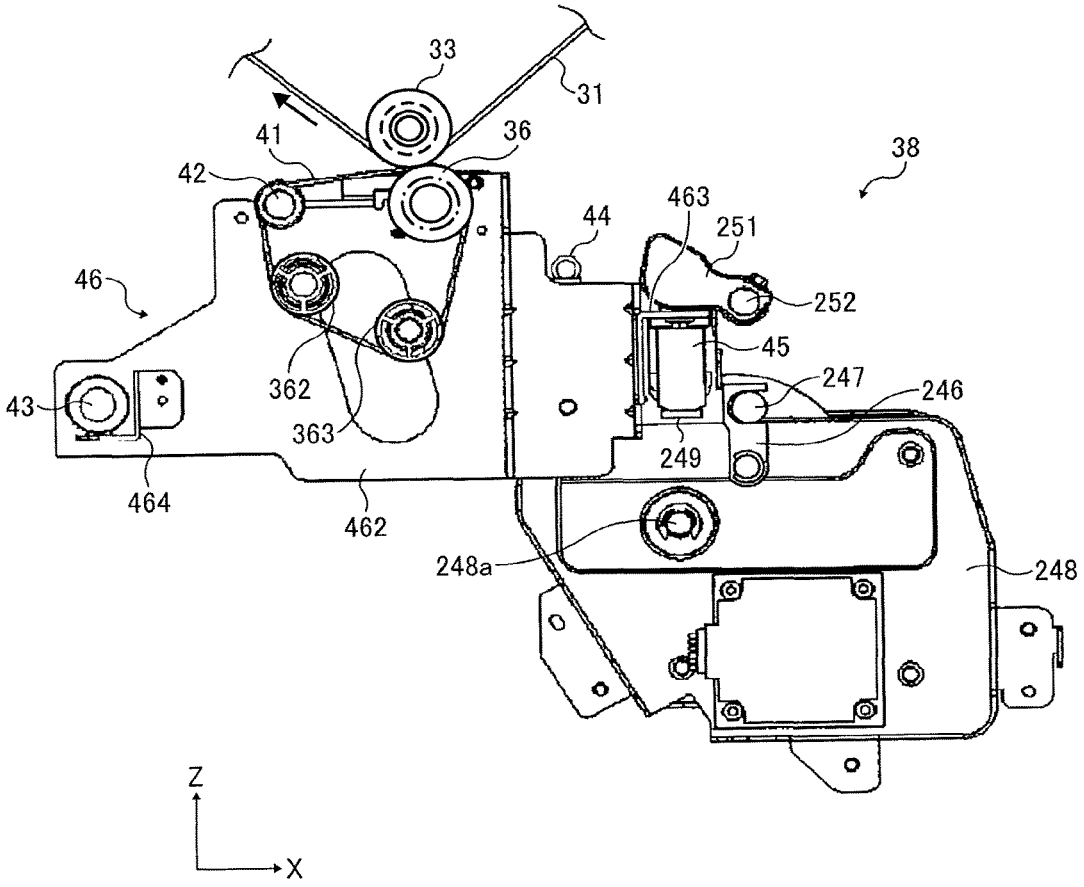
FIG. 22 is a front view of the sheet conveyor unit.
Figure 23:
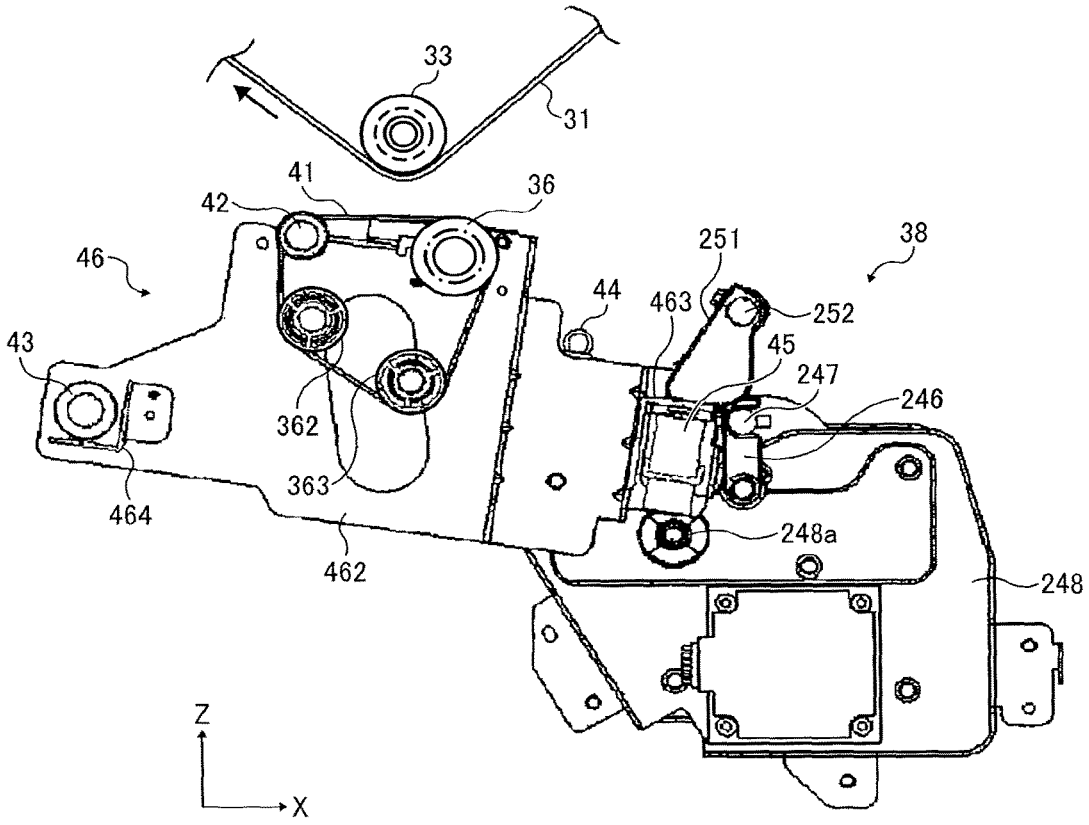
FIG. 23 is a front view of the sheet conveyor unit in a state of being spaced away from the intermediate transfer belt.
Figure 24:
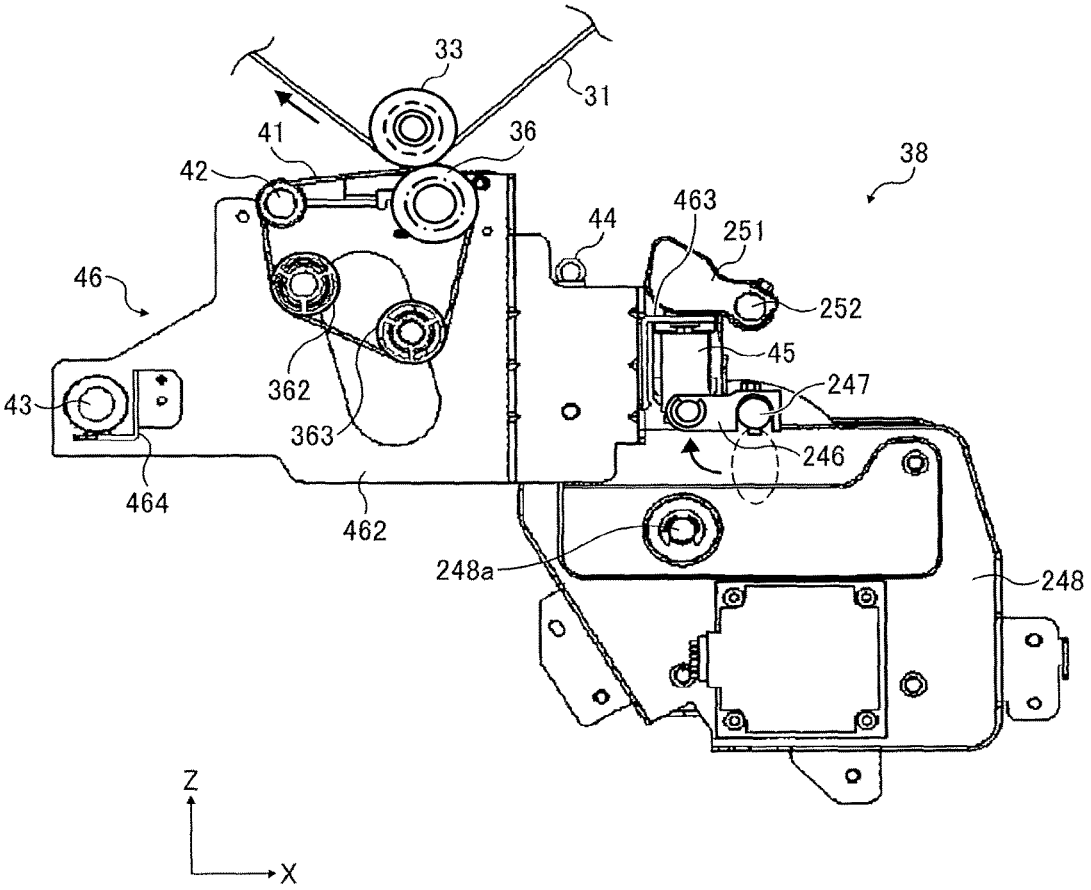
FIG. 24 is a front view of the sheet conveyor unit in which a pressure arm is in a retreated state.

FIG. 21 is a perspective view of the sheet conveyor unit 38 of an image forming apparatus according to the second embodiment. FIG. 22 is a front view of the sheet conveyor unit 38. FIG. 23 is a front view of the sheet conveyor unit 38 in a state of being spaced away from the intermediate transfer belt 31. FIG. 24 is a front view of the sheet conveyor unit 38 in which a pressure arm 246 is in a retreated state.

In FIGS. 21 through 24, the sheet conveyor unit 38 includes a pressure board 46 that rotatably supports both lateral ends of a rotation shaft of a secondary-transfer second roller 36. The pressure board 46 is rotatable around a pressure board rotation shaft 43 parallel to the rotation shaft of the secondary-transfer second roller 36.

The pressure board 46 receives a biasing force of a tensile spring 44 and a compression spring 45 as an elastic member on a side (right side in the drawing) at which the secondary-transfer second roller 36 is disposed in relation to a side at which the pressure board rotation shaft 43 is disposed, and thus torque for rotation around the pressure board rotation shaft 43 is given to the pressure board 46. Due to the torque, a site of the sheet conveyor belt 41, which is wound around the secondary-transfer second roller 36, comes into contact with the intermediate transfer belt 31, and thus a secondary transfer nipping pressure is generated between the sheet conveyor belt 41 and the intermediate transfer belt 31.

The tensile spring 44, which is a pressing member, is disposed to pull the pressure board 46 from an upper side, and applies an approximately constant biasing force to the pressure board 46. On the other hand, the compression spring 45, which is a pressing member, is disposed to push the pressure board 46 upward from a lower side, and is configured in such a manner that a lower end position of the compression spring 45 is displaceable in an upper and lower direction in accordance with a rotation angle of the pressure arm 246. The pressure arm 246 rotates around a pressure arm rotation shaft 247 by a rotation drive source 248. A stationary rotation angle of the pressure arm 246 can be changed by controlling the rotation drive source 248 by the controller.

The sheet conveyor unit 38 can switch a pressing force on one end side thereof between two stages by using the biasing force of a set of the tensile spring 44 and the compression spring 45 which are provided on one end side in an axial direction of the secondary-transfer second roller 36. The tensile spring 44 applies a pressing force of F1 N by the biasing force thereof. A pressure stay 249 is attached to a lower end of the compression spring 45, and when the pressure arm 246 pushes the pressure stay 249 upwardly, the biasing force by the compression spring 45 acts on the pressure board 46.

When the pressure arm 246 enters a retreated state in which the pressure arm 246 stops at a rotation angle position (second rotation angle) as illustrated in FIG. 22, the pressure arm 246 is detached from the pressure stay 249 that is attached to the lower end of the compression spring 45, and a compression amount of the compression spring 45 becomes zero (natural length). In this state, the biasing force of the compression spring 45 does not act on the pressure board 46, and thus the pressing force on the one side becomes F1 N due to only the biasing force of the tensile spring 44. When the pressure arm 246 stops at the second rotation angle illustrated in FIG. 22, the pressing force on the one end side is realized by only the biasing force due to the tensile spring 44 of which a variation rate in a restoring force with respect to a unit compression amount or a unit tensile amount is smaller than that of the compression spring 45. Accordingly, there is an advantage that it is easy to obtain a target secondary transfer nipping pressure.

On the other hand, when the pressure arm 246 enters a compression spring pressurized state in which the pressure arm 246 stops at a rotation angle position (first rotation angle) illustrated in FIG. 24, the pressure stay 249 attached to the lower end of the compression spring 45 is pushed upward. According to this, the compression spring 45 is compressed, and the biasing force of the compression spring 45 acts on the pressure board 46. In this state, a pressing force of F2 N is applied to the pressure board 46 due to the biasing force of the compression spring 45, and the pressing force on the one end side becomes F3 N that is the sum of F1 N due to the biasing force of the tensile spring 44 and F2 N due to the biasing force of the compression spring 45.

The above-description has been given of the pressure arm 246 on the one end side, but a pressure arm 246 on the other end side also switches the pressing force between F1 N and F3 N. When the two pressure arms 246 switch the biasing force, respectively, the secondary transfer nipping pressure is switched between 2×F1 N and 2×F3 N.

Examples of the tensile spring 44 include a spring member having a spring constant of 1.3 N/mm. In addition, examples of the compression spring 45 include a spring member having a spring constant of 2.6 N/mm.

The sheet conveyor unit 38 includes a separation arm 251 as a mover that moves the sheet conveyor belt 41 from a contact position at which the sheet conveyor belt 41 is brought into contact with a front surface of the intermediate transfer belt 31 to a separation position at which the sheet conveyor belt 41 is separated from the front surface. The separation arm 251 rotates around the center of the separation arm rotation shaft 252 with operation of a separation lever. With this configuration, the rotation angle position at which the arm 251 is stopped is changed by operating the lever.

The separation arm 251 is arranged in such a manner that a free end side portion thereof is located on an upper surface side of the pressure board 46. During an image formation operation, as illustrated in FIG. 22, the separation arm 251 stops at a rotation angle position at which the pressure board 46 is not pushed downward. In this state, the secondary-transfer second roller 36 is constrained to the contact position at which the secondary-transfer second roller 36 contacts the intermediate transfer belt 31.

By contrast, during a maintenance operation such as replacement of the secondary transfer unit or a jam treatment, an operator operates the separation lever to move the separation arm 251 to a rotation angle position illustrated in FIG. 23. In this state, the free end side portion of the separation arm 251 contacts the upper surface of the pressure board 46, and pushes the pressure board 46 downward against the biasing force of the tensile spring 44. According to this, the pressure board 46 rotates around the pressure board rotation shaft 43, and as illustrated in FIG. 23, the secondary-transfer second roller 36 moves to a separation position at which the secondary-transfer second roller 36 is separated from the intermediate transfer belt 31. Such separation facilitates operations of the maintenance treatment or the jam treatment to be carried out.

In the above-described retreated state, the pressure arm 246 is located out of a rotation range (movement route) of the pressure board 46, which rotates around the pressure board rotation shaft 43, by the separation arm 251 that moves in conjunction with the separation lever. Since the pressure arm 246 is located out of the rotation range of the pressure board 46, the secondary-transfer second roller 36 can move from the contact position to the separation position without being hindered by the pressure arm 246.

The sheet conveyor belt 41 having an endless shape is stretched by four rollers including the secondary-transfer second roller 36, a separation roller 42, a secondary transfer first stretching roller 362, and a secondary transfer second stretching roller 363. The four rollers are supported by the above-described transfer unit 30, and it is possible to detach the sheet conveyor belt 41 from the pressure board 46 in combination with the four rollers by detaching the transfer unit 30 from the pressure board 46.

The pressure board 46 supports both ends of the secondary-transfer second roller 36 in an axial direction (Y direction in FIG. 21), and includes a front side plate 461 and a rear side plate 462 which determine a position of the secondary-transfer second roller 36 with respect to the pressure board 46. The front side plate 461 and the rear side plate 462 are connected to each other through two stays including a rotation shaft side stay 464 as a stopper that extends in the Y direction in FIG. 21, and a pressure side stay 463 as a displaceable stopper.

The pressure board 46 forms a structure body, in which a shape from an upper side (in a X-Y plane in the drawing) is an approximately rectangular shape, by the front side plate 461, the rear side plate 462, the rotation shaft side stay 464, and the pressure side stay 463. The front side plate 461 rotatably supports a front end of the secondary-transfer second roller 36 in an axial direction at a front side plate bearing portion 461*a*. In addition, the rear side plate 462 rotatably supports an inner end of the secondary-transfer second roller 36 in the axial direction at a rear side plate bearing portion 462*a*.

The rotation shaft side stay 464 is made of sheet metal, and portions in the vicinity of both ends in the axial direction (Y direction) are bent at a right angle and form opposing faces which are opposite to the front side plate 461 and the rear side plate 462, respectively. The opposing faces are fixed to the front side plate 461 and the rear side plate 462, respectively, and thus rotation shaft sides of the respective side plates restrict relative movement between the respective side plates in an axial direction (Y direction) by the rotation shaft side stay 464. Since these opposing planes of the second stay 424 at both ends thereof in the axial direction facing the front lateral plate 421 and the rear lateral plate 422 are fixed to the front lateral plate 421 and the rear lateral plate 422, the front lateral plate 421 and the rear lateral plate 422 are reinforced. As described above, the opposing faces, which are opposite to the front side plate 461 and the rear side plate 462, of the both ends of the rotation shaft side stay 464 in the axial direction function as a reinforcing portions which reinforce the respective front side plate 461 and the rear side plate 462.

In the image forming apparatus according to the second embodiment, the sheet conveyor unit 38 serves as a nipping pressure adjuster to adjust the secondary-transfer nipping pressure.

The present inventors have prepared a test printer that is capable of adjusting the secondary-transfer nipping pressure at two stages of level in the same manner as the sheet conveyor unit 38 of the image forming apparatus according to the second embodiment. The inventors of the present application have performed an experiment in which a blue solid image, in which two colors are superimposed on each other, was printed in an uneven surface sheet by using the test printer.

Two types, LEATHAC 66 (175 kg) and LEATHAC 66 (215 kg), were used as the uneven surface sheet. With an increase in basis weight, the degree (depth) of recess in the uneven surface increases. The tests were performed under laboratory atmospheric conditions at 23° C. and 50% RH. The process linear velocity was set 630 mm/s. The following two types of secondary-transfer bias was adopted.

1) the DC voltage under constant current control with a target output current value of −120 μA.

2) the superimposed voltage in which the AC voltage having a peak-to-peak value Vpp of 9 kV and a high duty of 12% is superimposed on the DV voltage under constant current control with a target output current value of −120 μA.

The secondary-transfer nipping pressure was applied at the three stages of level, high, middle, and low. The test printer is designed to apply the secondary-transfer nipping pressure at two stages of level as described above. Accordingly, the compression spring 45 was changed to one having a different spring constant to change the secondary-transfer nipping pressure at three stages of level.

The blue solid image printed on the uneven surface sheet was evaluated for the transferability (the transferability in recesses) of toner in the recesses of the uneven surface sheet. Specifically, Grade 5 indicates that the density in a recess of the uneven surface sheet was sufficient with visual observation. In this case, the sufficient amount of toner is transferred into the recesses of the uneven surface sheet. Grade 4 indicates that a white void (toner is partly absent) occurs in a small area of a recess or the image density of the recess is slightly lower than the image density of a protrusion. Grade 3 indicates that the area of a white void is greater than that of Grade 4 or the reduction in density is prominent as compared to that of Grade 4. Grade 2 indicates that the area of the white voids is greater than that of Grade 3 or the reduction in density is prominent as compared to that of Grade 3. Grade 1 indicates that a recess looks generally white and looks like a shape of groove in a clear manner or even worse (less density).

The results are represented in Table 3.

TABLE 3

| TYPE OF UNEVEN SURFACE | SECONDARY-TRANSFER BIAS | | | SECONDARY TRANSFER NIPPING | RANK OF TRANSFERABILITY |
|---|---|---|---|---|---|
| SHEET | TYPE | Vpp Kv | DUTY % | PRESSURE | IN RECESSES |
| LEATHAC 66 | AC + DC | 9 | 12 | HIGH | 5 |
| 215 kg | AC + DC | 9 | 12 | MIDDLE | 4 |
| | AC + DC | 9 | 12 | LOW | 4 |
| | DC Only | — | — | MIDDLE | 2 |
| LEATHAC 66 | AC + DC | 11 | 12 | HIGH | 5 |
| 175 kg | AC + DC | 11 | 12 | MIDDLE | 4 |
| | AC + DC | 11 | 12 | LOW | 3 |
| | DC Only | — | — | MIDDLE | 1 |

As represented in Table 3, when the secondary-transfer bias including only the DC voltage is used, the transferability in recesses deteriorates as compared to the case in which the secondary-transfer bias including the superimposed voltage with the low duty is used.

It has been found that no particular differences in transferability in recesses depending on the secondary-transfer nipping pressure were recognized between the sheets of LEATHAC 66 having different basis weights. The sheet having a basis weight of 215 kg has a greater degree of recess than the sheet having a basis weight of 175 kg, and accordingly the transferability in recesses deteriorates in the sheet having a basis weight of 215 kg as compared to the sheet having a basis weight of 175 kg. However, with an increase in peak-to-peak value Vpp, the transferability in recesses in the sheet having a basis weight of 215 kg increases and thereby the level of evaluation (Grade) increases to the same level of the sheet having a basis weight of 175 kg. With an excessively increased peak-to-peak value Vpp, the transfer-peak value Vt increases to be greater than the voltage that starts the electric discharge between the surface of the intermediate transfer belt 31 and the surface of the sheet, thereby causing the occurrence of the electric discharge frequently, thus generating many white spots due to the electric discharge. The deterioration in image quality due to such many white spots is worse than the deterioration in image quality due to the toner-transfer failure in recesses. Thus, the peak-to-peak value Vpp is preferably reduced to a degree that prevents the occurrence of many white spots.

In terms of differences in transferability in recesses of the same type of the uneven surface sheet with the secondary-transfer nipping pressure, with an increase in secondary-transfer nipping pressure, the transferability in recesses increases. This is because, with an increase in secondary-transfer nipping pressure, the degree of contact between the recesses of the uneven surface sheet and the surface of the intermediate transfer belt 31 increases. Thus, it is preferable that the secondary-transfer nipping pressure is relatively increased in terms of the transferability in the recesses of the uneven surface sheet.

The inventors of the present application have performed an experiment in which a halftone image in black color is printed in a smooth sheet by using the prototype image forming apparatus.

As a smooth sheet, "MOHAWK COLOR COPY GLOSS (registered trademark) 270 gsm" that is a coated paper was used. The tests were performed under laboratory atmospheric conditions at 23° C. and 50% RH. The process linear velocity was set 630 mm/s. The secondary-transfer nipping pressure was applied at the three stages of level, high, middle, and low in the same manner as the above-described experiment.

The following two types of secondary-transfer bias was adopted.

1) the DC voltage under constant current control with a target output current value of −120 μA.

2) the superimposed voltage in which the AC voltage having a peak-to-peak value Vpp of 6.4 kV and a high duty of 85% is superimposed on the DV voltage under constant current control with a target output current value of −120 μA.

The halftone image printed on the smooth sheet is evaluated for the transferability (the HT transferability). Specifically, Grade 5 indicates that the density of the halftone image was sufficient with visual observation. Grade 4 indicates that a density was slightly lighter than that of Grade 5 but there was no problem. Grade 3 indicates that the density was lower than that of Grade 4, and desired image quality to satisfy users was not obtained. Grade 2 indicates that the density was lower than that of Grade 3. Grade 1 indicates that the test image looked generally white or even whiter (less density). The acceptable image quality to satisfy users was Grade 4 or above.

The results are represented in Table 4.

TABLE 4

| TYPE OF SMOOTH | SECONDARY-TRANSFER BIAS | | | SECONDARY TRANSFER NIPPING | RANK OF HT |
|---|---|---|---|---|---|
| SHEET | TYPE | Vpp Kv | DUTY % | PRESSURE | TRANSFERABILITY |
| Mohawk | AC + DC | 6.4 | 85 | HIGH | 3 |
| Color | AC + DC | 6.4 | 85 | MIDDLE | 4 |
| Copy | AC + DC | 6.4 | 85 | LOW | 5 |
| Gloss | DC Only | — | — | MIDDLE | 2 |
| 270 kg | | | | | |

As represented in Table 4, when the secondary-transfer bias including only the DC voltage is used, the HT transferability deteriorates as compared to the case in which the secondary-transfer bias including the superimposed voltage is used.

In terms of differences in HT transferability with the secondary-transfer nipping pressure, with an increase in secondary-transfer nipping pressure, the HT transferability deteriorates as contrary to the transferability in recesses. This is because, with an increase in secondary-transfer nipping pressure, the area of the elastically-deformed intermediate transfer belt 31 that covers the toner masses on the surface of the smooth sheet increases, thereby increasing the amount of injection of the charges having the opposite polarity into toner. Thus, it is preferable that the secondary-transfer nipping pressure is relatively reduced in terms of the HT transferability on the smooth sheet.

In view of the above-described experimental results, the image forming apparatus according to the second embodiment includes a main controller to be described below to increase the secondary-transfer nipping pressure in the low-smooth mode as compared to the secondary-transfer nipping pressure in the high-smooth mode. With such a configuration, the secondary-transfer nipping pressure is relatively increased to increase the transferability in recesses in the low-smooth mode. Further, the secondary-transfer nip is relatively reduced to increase the HT transferability in the high-smooth mode.

Figure 25:
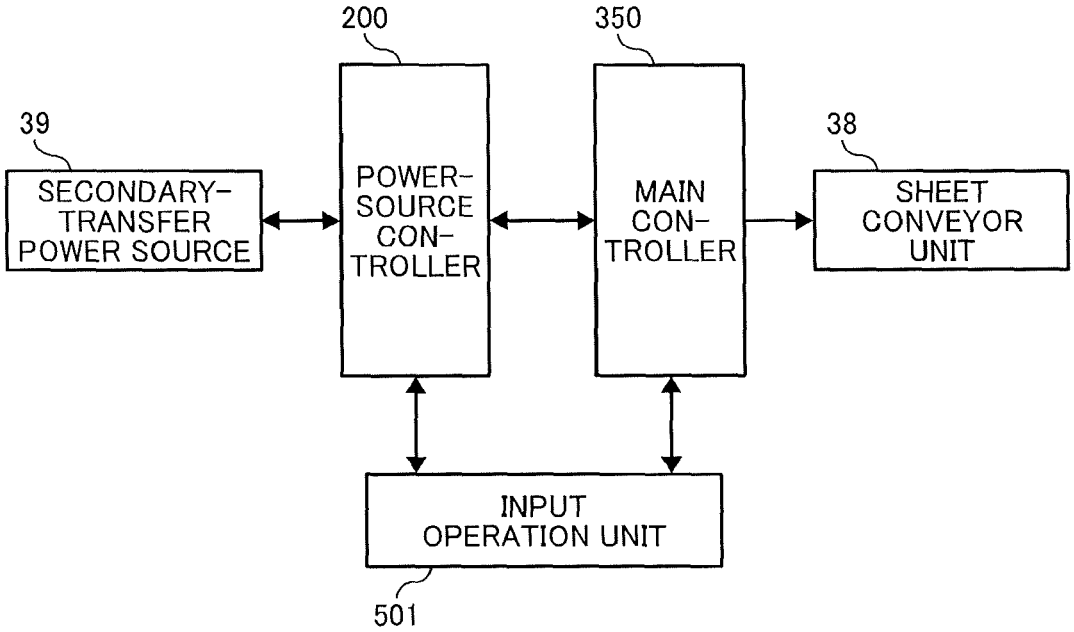
FIG. 25 is a block diagram of electrical circuitry of the image forming apparatus according to the second embodiment of the present disclosure.

FIG. 25 is a block diagram illustrating electrical circuitry of the image forming apparatus according to a second embodiment of the present disclosure. As can be seen from the FIG. 21, a main controller 350, which controls drive of respective devices of the image forming apparatus, is connected to the power-source controller 200 that controls an output of the secondary transfer bias from the secondary transfer power source 39. The input operation unit 501 having received information sends the information to the power-source controller 200 and the main controller 350.

In the low-smooth mode, the main controller 350 controls the sheet conveyor unit 38 to set the secondary transfer nipping pressure to F3 N. According to this, toner is transferred to a deeper position in the recesses of the uneven surface sheet in a favorable manner to obtain very good toner transfer properties at the recesses. In the high-smooth mode, the main controller 350 controls the sheet conveyor unit 38 to set the secondary transfer nipping pressure to F1 N. Due to this, the HT transferability improves.

Note that the configuration of the above-described Variation, the first Example or the second Example may be added to the image forming apparatus according the second embodiment.

Although the embodiment of the present disclosure has been described above, the present disclosure is not limited to the foregoing embodiments, but a variety of modifications can naturally be made within the scope of the present disclosure.

[Aspect A]

In Aspect A, an image forming apparatus (for example, a printer) includes an image bearer (for example, the intermediate transfer belt 31) hearing a toner image; a nip forming member (for example, the sheet conveyor belt 41) contacting the image bearer to form a transfer nip (for example, the secondary-transfer nip N); a transfer power source (the secondary-transfer power source 39) to output a transfer bias (for example, a secondary-transfer bias) including a superimposed voltage, in which a direct current (DC) voltage and an alternating current (AC) voltage are superimposed on each other, to flow a transfer current (for example, the secondary-transfer current) into the transfer nip to transfer the toner image borne on the image bearer onto a recording sheet disposed between the image bearer and the nip forming member. The transfer bias has a transfer peak value to electrostatically move toner from the image bearer to the nip forming member in a greater manner and an opposite-peak value that is an opposite side of the transfer peak value. The image forming apparatus further includes an information acquisition unit (for example, the input operation unit 501 and the smoothness sensor 502) acquires information regarding surface smoothness of the recording sheet to be subjected to transferring of the toner image and a controller (for example, the power-source controller 200). The controller switches a transfer mode between a first mode to transfer the toner image onto a first type sheet having a higher surface smoothness and a second mode to transfer the toner image onto a second type sheet having a lower surface smoothness than the surface smoothness of the first type sheet based on the information acquired by the information acquisition unit. The controller controlling the transfer power source to output the transfer bias having an opposite-peak duty of greater than or equal to 50% that is a duty on the side of the opposite-peak value in the first mode, and the controller controlling the transfer power source to output the transfer bias having an opposite-peak duty of less than 50% that is different from the opposite-peak duty of the first mode in the second mode.

In such a configuration, using an image bearer having an elasticity increases the degree of contact between the surface of the image bearer and the surface of the low-smooth sheet in the transfer nip, thereby reducing the distance between the surface of the image bearer and the surface of the bottoms of the recesses of the low-smooth sheet. The reduction in such a distance allows for a successful transfer of toner relative to the recesses of the uneven surface of the low-smooth sheet even in a high-speed printing that responds to a demand for business use. However, with an excessively increased peak-to-peak value of the AC voltage of the transfer bias to achieve such a successful transfer, the electric discharge frequently occurs in the transfer nip, thereby causing the occurrence of many white spots due to the electric discharge. In contrast, with the use of a high-smooth sheet having a good surface smoothness as a recording sheet, the charges having the opposite polarity are injected into toner in the transfer nip, and thereby the transfer failure of a toner image is more likely to occur.

According to Aspect A, in the case of using the low-smooth sheet, a toner image is transferred onto the low-smooth sheet by using the transfer bias having an opposite-peak duty of less than 50% that is different from the opposite-peak duty in the case of using the high-smooth sheet. This allows transferring of a sufficient amount of toner into the recesses of the uneven surface with the transfer bias of a much smaller peak-to-peak value than that of the transfer bias having the opposite-peak duty of 50%. Such a configuration prevents the transfer failure of toner into the recesses of the uneven surface of the low-smooth sheet and the occurrence of white spots in an image. In the case of using the high-smooth sheet, the opposite-peak duty is greater than or equal to 50% that is different from the value of the opposite-peak duty in the case of using the low-smooth sheet. Thus, the charges having the opposite polarity is prevented from being injected into toner in the transfer nip, thereby preventing the occurrence of the transfer failure of a toner image relative to the high-smooth sheet as compared to the chase in which the opposite-peak duty is less than 50%.

As described above, the configuration according to Aspect A prevents the transfer failure of toner onto the recesses of the uneven surface and the occurrence of white spots in an image in the case of using the low-smooth sheet, while achieving high-speed printing. The configuration according to Aspect A further prevents the transfer failure of a toner image onto the high-smooth sheet.

[Aspect B]

In Aspect B according to Aspect A, the image forming apparatus includes a nipping pressure adjuster (for example, the sheet conveyor unit 38) to adjust the transfer nipping pressure. The controller (for example, the power-source controller 200 and the main controller 350) controls the nipping pressure adjuster to increase the pressure of the transfer nip in the second mode to be greater than the pressure of the transfer nip in the first mode. In such a configuration, the transfer nipping pressure is relatively increased in the low-smooth mode to increase the transferability of toner relative to the recesses of the uneven surface sheet. Further, in such a configuration, the secondary-transfer nipping pressure is relatively reduced in the high-smooth mode to increase the transferability of an image relative to the smooth surface of the smooth sheet.

[Aspect C]

In Aspect C according to Aspect A or Aspect B, the controller controls the transfer power source to output the transfer bias having the opposite-peak duty that exceeds 50% in the first mode. The controller controls the transfer power source to output the transfer bias that reverses a polarity during one cycle and that has the opposite-peak duty of less than 50% in the second mode. Such a configuration exhibits the following advantageous effects in the high-smooth mode or the low-smooth mode as compared to the case of the opposite-peak duty of 50%. The transferability of toner relative to the recesses of the uneven surface of the low-smooth sheet increases. The transfer failure of a toner image relative to the high-smooth sheet is prevented.

[Aspect D]

In Aspect D according to Aspect C, the controller controls the transfer power source to output the transfer bias having an opposite-peak duty that ranges from 70% through 90% in the first mode. Such a configuration reliably prevents the occurrence of the transfer failure of a toner image relative to the high-smooth sheet.

[Aspect E]

In Aspect E according to Aspect B or Aspect C, the controller controls the transfer power source to output the transfer bias having an opposite-peak duty that ranges from 8% through 35% in the second mode. Such a configuration successfully transfers a sufficient amount of toner onto the recesses of the uneven surface of the low-smooth sheet.

[Aspect F]

In Aspect F according to Aspect E, the controller controls the transfer power source to output the transfer bias having an opposite-peak duty of less than 17% in the second mode. Such a configuration further increases the transferability of toner relative to the recesses of the uneven surface of the low-smooth sheet.

[Aspect G]

In Aspect according to any of Aspect C through Aspect F, the controller controls the transfer power source to output the transfer bias that does not reverse the polarity in the first mode. Such a configuration reliably prevents the secondary-transfer failure relative to the high-smooth sheet as compared to the case in which the secondary-transfer bias reverses the polarity during one cycle.

[Aspect H]

In Aspect H according to any of Aspect A through Aspect G, the image bearer has a multi-layer structure including a base layer (for example, the base layer 31*a*) and an elastic layer (for example, the elastic layer 31*b*) having a greater elasticity than the elasticity of the base layer on the base layer. In such a configuration, the elastic layer flexibly deforms in the transfer nip, thereby increasing the transferability of toner relative to the recesses of the uneven surface of the low-smooth sheet, thus achieving the high-speed printing that responds to a demand for business users.

[Aspect I]

In Aspect I According to Aspect H, the image bearer has a micro-rubber hardness ranging from 50 through 80. In such a configuration, the elastic layer flexibly deforms in conformity with the shape of the toner masses in the transfer nip.

[Aspect J]

In Aspect J according to any of Aspects A through I, the information acquisition unit includes a smoothness sensor (for example, the smoothness sensor 502) to detect the surface smoothness of the recording sheet. The controller switches the transfer mode between the first mode and the second mode based on a detection result of the smoothness sensor. Such a configuration allows automatically determining whether a recording sheet subjected to the transfer of a toner image is the high-smooth sheet or the low-smooth sheet without an operation of a user, thus increasing the operability.

[Aspect K]

In Aspect K according to any of Aspects A through I, the information acquisition unit serves as an input operation unit (for example, the input operation unit 501) through which a user performs an input operation of the information. Such a configuration allows acquiring information regarding whether the recording sheet subjected to the transfer of a toner image is the high-smooth sheet or the low-smooth sheet through the operation of a user.

[Aspect L]

In Aspect L according to Aspect K, the input operation unit includes a first input part (for example, the smooth sheet button 501*a*) that is dedicated to input information that the recording sheet is the first type sheet and a second input part (for example, the uneven sheet button 501*b*) that is dedicated input information that the recording sheet is the second type sheet. Such a configuration increases the operability of the input of users with the provision of dedicated input units.

[Aspect M]

In Aspect M according to Aspect K, the input operation unit includes a brand input unit to input a brand of the recording sheet. The controller controls the transfer power source to output the transfer bias having a lower opposite-peak duty with an increase in degree of a surface unevenness of the recording sheet of the brand input into the input operation unit in the second mode. Such a configuration allows transferring a sufficient amount of toner onto the recesses of the uneven surface sheet having a relatively high degree of unevenness of the uneven surface sheet in the low-smooth mode. In addition, a halftone image is secondarily transferred onto the protrusions of the uneven surface sheet having a relatively low degree of unevenness in the uneven surface sheet in a successful manner.

[Aspect N]

In Aspect N according to any of Aspect A through Aspect M, the controller controls the transfer power source to output the transfer bias having a higher frequency in the first mode than a frequency of the transfer bias in the second mode. Such a configuration increases the transferability of a halftone image in the high-smooth mode and increases the transferability of toner relative to the recesses of the uneven surface of the low-smooth sheet in the low-smooth mode.

[Aspect O]

In Aspect O according to any of Aspect A through Aspect N, the controller controls the transfer power source to output the transfer bias including the superimposed bias with a lower peak-to-peak value in the first mode than a peak-to-peak value of the transfer bias in the second mode. Such a configuration increases the transferability of a halftone image in the high-smooth mode and increases the transferability of toner relative to the recesses of the uneven surface of the low-smooth sheet in the low-smooth mode.

[Aspect P]

In Aspect P according to any of Aspect A through Aspect O, the controller controls the transfer power source to output the transfer bias including a greater value of the DC voltage included in the superimposed voltage in the first mode than a value of the DC voltage included in the superimposed voltage of the transfer bias in the second mode. Such a configuration increases the transferability of a halftone image in the high-smooth mode and increases the transferability of toner relative to the recesses of the uneven surface of the low-smooth sheet in the low-smooth mode. In addition, the occurrence of white spots is prevented in the high-smooth mode.

[Aspect Q]

In Aspect Q according to Aspect H or Aspect I, the elastic layer includes an elastic surface layer having a plurality of fine projections made of a plurality of fine particles dispersed in a material of the elastic surface layer. With this configuration, the fine particles in the surface of the elastic layer can reduce the contact area of the elastic layer with the toner in the transfer nip, hence enhancing the ability of separation of the toner separating from the image bearer surface and thus enhancing the transfer efficiency.

[Aspect R]

According to Aspect R, an image forming method includes outputting a transfer bias including a superimposed bias, in which a direct current (DC) voltage and an alternating current (AC) voltage are superimposed on each other, from a transfer power source to a transfer nip formed by an image bearer contacting a nip forming member; transferring a toner image from the image bearer onto a recording sheet disposed between the image bearer and the nip forming member; acquiring information regarding whether the recording sheet to be subjected to the transferring of the toner image is a first type sheet having a higher surface smoothness or a second type sheet having a lower surface smoothness than the surface smoothness of the first type sheet; switching a transfer mode between a first mode to transfer the toner image onto the first type sheet and a second mode to transfer the toner image onto the second type sheet; and controlling the transfer power source to output the transfer bias having an opposite-peak duty of greater than or equal to 50% in the first mode and output the transfer bias having an opposite-peak duty of less than 50% that is different from the opposite-peak duty of the first mode in the second mode. With such a configuration, a sufficient amount of toner is transferred onto the recesses of the low-smooth sheet having an inferior surface smoothness and prevents the occurrence of the transfer failure of a toner image relative to the high-smooth sheet having a superior surface smoothness, while achieving the high-speed printing.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image bearer bearing a toner image;

a nip forming member contacting the image bearer to form a transfer nip;

a transfer power source to output a transfer bias including a superimposed voltage, in which an alternating current (AC) voltage is superimposed on a direct current (DC) voltage, to transfer the toner image borne on the image bearer onto a recording sheet disposed between the image bearer and the nip forming member, two peak values of the transfer bias being a transfer peak value to move toner from the image bearer to the nip forming member and an opposite-peak value in an opposite side of the transfer peak value; and a controller to switch a transfer mode between a first mode to transfer the toner image onto a first type sheet having a surface smoothness higher than a surface smoothness of a second type sheet and a second mode to transfer the toner image onto the second type sheet, wherein the controller controls the transfer power source to output the transfer bias having an opposite-peak duty that exceeds 50% that is a duty on the side of the opposite-peak value in the first mode, and wherein the controller controls the transfer power source to output the transfer bias having an opposite-peak duty of less than 50% in the second mode.

2. The image forming apparatus according to claim 1, further comprising a nipping pressure adjuster to adjust pressure of the transfer nip, wherein the controller controls the nipping pressure adjuster to increase the pressure of the transfer nip in the second mode to be greater than the pressure of the transfer nip in the first mode.

3. The image forming apparatus according to claim 1, wherein the controller controls the transfer power source to output the transfer bias that reverses a polarity during one cycle and that has the opposite-peak duty of less than 50% in the second mode.

4. The image forming apparatus according to claim 3, wherein the controller controls the transfer power source to output the transfer bias having an opposite-peak duty that ranges from 70% through 90% in the first mode.

5. The image forming apparatus according to claim 3, wherein the controller controls the transfer power source to output the transfer bias having an opposite-peak duty that ranges from 8% through 35% in the second mode.

6. The image forming apparatus according to claim 5, wherein the controller controls the transfer power source to output the transfer bias having an opposite-peak duty of less than or equal to 17% in the second mode.

7. The image forming apparatus according to claim 3, wherein the controller controls the transfer power source to output the transfer bias that does not reverse the polarity in the first mode.

8. The image forming apparatus according to claim 1, wherein the image bearer has a multi-layer structure including a base layer and an elastic layer on the base layer, and wherein the elastic layer has a greater elasticity than an elasticity of the base layer.

9. The image forming apparatus according to claim 8, wherein the image bearer has a micro-rubber hardness ranging from 50 through 80.

10. The image forming apparatus according to claim 8, wherein the elastic layer includes an elastic surface layer having a plurality of fine projections made of a plurality of fine particles dispersed in a material of the elastic surface layer.

11. An image forming apparatus comprising:

an image bearer bearing a toner image;

a nip forming member contacting the image bearer to form a transfer nip;

a transfer power source to output a transfer bias including a superimposed voltage, in which an alternating current (AC) voltage is superimposed on a direct current (DC) voltage, to transfer the toner image borne on the image bearer onto a recording sheet disposed between the image bearer and the nip forming member, two peak values of the transfer bias being a transfer peak value to move toner from the image bearer to the nip forming member and an opposite-peak value in an opposite side of the transfer peak value;

a controller to switch a transfer mode between a first mode to transfer the toner image onto a first type sheet having a surface smoothness higher than a surface smoothness of a second type sheet and a second mode to transfer the toner image onto the second type sheet and an information acquisition unit to acquire information regarding surface smoothness of the recording sheet that is a transfer target of the toner image, wherein the controller controls the transfer power source to output the transfer bias having an opposite-peak duty of greater than or equal to 50% that is a duty on the side of the opposite-peak value in the first mode, wherein the controller controls the transfer power source to output the transfer bias having an opposite-peak duty of less than 50% in the second mode, and wherein the controller switches the transfer mode between the first mode and the second mode based on the information acquired by the information acquisition unit.

12. The image forming apparatus according to claim 11, wherein the information acquisition unit includes a smoothness sensor to detect the surface smoothness of the recording sheet, and wherein the controller switches the transfer mode between the first mode and the second mode based on a detection result of the smoothness sensor.

13. The image forming apparatus according to claim 11, wherein the information acquisition unit is an input operation unit to input the information according to an input operation.

14. The image forming apparatus according to claim 13, wherein the input operation unit includes:

a first input part to input information that the recording sheet is the first type sheet; and a second input part to input information that the recording sheet is the second type sheet.

15. The image forming apparatus according to claim 13, wherein the input operation unit includes a brand input unit to input a brand of the recording sheet, wherein the controller controls the transfer power source to output the transfer bias having a lower opposite-peak duty as a surface unevenness of the recording sheet of the brand input into the input operation unit in the second mode is greater.

16. The image forming apparatus according to claim 1, wherein the controller controls the transfer power source to output the transfer bias having a higher frequency in the first mode than a frequency of the transfer bias in the second mode.

17. The image forming apparatus according to claim 1, wherein the controller controls the transfer power source to output the transfer bias including the superimposed voltage with a lower peak-to-peak value in the first mode than a peak-to-peak value of the transfer bias in the second mode.

18. The image forming apparatus according to claim 1, wherein the controller controls the transfer power source to output the transfer bias including a greater value of the DC voltage included in the superimposed voltage in the first mode than a value of the DC voltage included in the superimposed voltage of the transfer bias in the second mode.

19. An image forming method comprising:

outputting a transfer bias including a superimposed bias, in which an alternating current (AC) voltage is superimposed on a direct current (DC) voltage, from a transfer power source to a transfer nip formed by an image bearer contacting a nip forming member;

transferring a toner image from the image bearer onto a recording sheet disposed between the image bearer and the nip forming member, two peak values of the transfer bias being a transfer peak value to move toner from the image bearer to the nip forming member and an opposite-peak value in an opposite side of the transfer peak value;

switching a transfer mode between a first mode to transfer the toner image onto a first type sheet having a surface smoothness higher than a surface smoothness of a second type sheet and a second mode to transfer the toner image onto the second type sheet; and controlling the transfer power source to output the transfer bias having an opposite-peak duty that exceeds 50% in the first mode and output the transfer bias having an opposite-peak duty of less than 50%, which is different from the opposite-peak duty of the first mode, in the second mode.

20. The image forming method according to claim 19, further comprising acquiring information regarding whether the recording sheet that is a transfer target of the toner image is the first type sheet or the second type sheet.

* * * * *